US010971124B2

(12) United States Patent
Goto et al.

(10) Patent No.: US 10,971,124 B2
(45) Date of Patent: Apr. 6, 2021

(54) PEDAL DEVICE OF ELECTRONIC KEYBOARD INSTRUMENT

(71) Applicant: Roland Corporation, Shizuoka (JP)

(72) Inventors: Yutaka Goto, Shizuoka (JP); Yoshiyasu Kitagawa, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/562,420

(22) Filed: Sep. 5, 2019

(65) Prior Publication Data

US 2020/0111466 A1 Apr. 9, 2020

(30) Foreign Application Priority Data

Oct. 4, 2018 (JP) ..... JP2018-189430

(51) Int. Cl.
*G10H 1/34* (2006.01)
*G10H 1/00* (2006.01)

(52) U.S. Cl.
CPC ..... *G10H 1/348* (2013.01); *G10H 1/0008* (2013.01)

(58) Field of Classification Search
CPC ..... G10H 1/348; G10H 1/0008
USPC ..... 84/746
See application file for complete search history.

(56) References Cited

U.S. PATENT DOCUMENTS 4,744,279 A * 5/1988 Livingston ..... G10H 1/0556 84/422.1
7,893,334 B2 * 2/2011 Iwamoto ..... G10H 1/346 84/422.1
8,378,204 B2 * 2/2013 Arayama ..... G10H 1/32 84/746
2001/0037718 A1 * 11/2001 Maehara ..... G10C 1/04 84/426
2006/0096448 A1 * 5/2006 Yoshino ..... G10H 1/34 84/734
2008/0314230 A1 * 12/2008 Sasaki ..... G09B 15/00 84/601
2009/0235803 A1 * 9/2009 Iwamoto ..... G10H 1/346 84/229
2009/0314156 A1 * 12/2009 Komatsu ..... G10H 1/348 84/626
2011/0061518 A1 * 3/2011 Iwamoto ..... G10H 1/348 84/746
2016/0012806 A1 * 1/2016 Mori ..... G10D 13/00 84/746
2019/0066646 A1 * 2/2019 Tanida ..... G10D 13/00
2020/0111466 A1 * 4/2020 Goto ..... G10H 1/348

FOREIGN PATENT DOCUMENTS

JP 2009258642 11/2009
JP 2013205495 10/2013

* cited by examiner

*Primary Examiner* — David S Warren
*Assistant Examiner* — Christina M Schreiber
(74) *Attorney, Agent, or Firm* — JCIPRNET

(57) ABSTRACT

A pedal device of electronic keyboard instrument is provided. The pedal device of an electronic keyboard instrument includes a damper which applies resistance forces against rotation of pedals to the pedals during rotation of the pedals toward at least one of a first direction and a second direction.

19 Claims, 16 Drawing Sheets

PEDAL DEVICE OF ELECTRONIC KEYBOARD INSTRUMENT

CROSS-REFERENCE TO RELATED APPLICATION

This application claims the priority of Japan patent application serial no. 2018-189430, filed on Oct. 4, 2018. The entirety of the above-mentioned patent application is hereby incorporated by reference herein and made a part of this specification.

BACKGROUND OF THE DISCLOSURE

Technical Field

The disclosure relates to a pedal device of electronic keyboard instrument.

Related Art

In recent years, an electronic keyboard instrument such as an electronic piano which reproduces timbre, operability, appearance and the like of an acoustic piano in a pseudo manner is widespread. A pedal device which is used in this kind of electronic keyboard instrument may be a pedal device which includes shake suppression members operating in conjunction with levers (pedals) and suppressing shake of the levers, and friction generation members supported by support members and being in contact with the shake suppression members to generate frictional forces (for example, patent literature 1). In addition, there is a pedal device which includes friction materials which rotate on at least one of side surfaces of the pedals and guide portions which guide the pedals and apply friction forces to the pedals (for example, patent literature 2). According to these pedal devices, by using the friction forces against the pedals to apply resistance forces against rotation to the pedals, a characteristic of operation loads (reaction forces) to stepping amounts of the pedals is caused to have a hysteresis characteristic, and as a result, operation feelings similar to pedals of an acoustic piano can be achieved.

LITERATURE OF RELATED ART

Patent Literature

[Patent literature 1] Japanese Laid-Open No. 2009-258642
[Patent literature 2] Japanese Laid-Open No. 2013-205495

However, if the following configuration is employed in which predetermined members are pressed against the pedals and the resistance forces against rotation are applied to the pedals by friction forces between the pedals and the members which are generated during rotation of the pedals, a problem below is generated. That is, because the pedals and the members are worn due to the friction forces in the parts where the pedals and the members are in contact with each other, a decrease in the friction forces is caused, and as a result, there is a risk that a desired load characteristic cannot be obtained for a long period.

SUMMARY

The disclosure employs configurations below. That is, the disclosure is a pedal device of electronic keyboard instrument which includes a chassis, a pedal rotatably supported by the chassis and rotating in a first direction due to an stepping operation, and a first urging unit for applying, to the pedal, an urging force which intends to make the pedal rotate toward a second direction opposite to the first direction corresponding to the stepping amount of the pedal, and a damper which applies a resistance force against the rotation of the pedal to the pedal during the rotation of the pedal toward at least one of the first direction and the second direction.

A pedal device of electronic keyboard instrument, comprising: a chassis; a pedal rotatably supported by the chassis; a first urging unit for applying an urging force to the pedal corresponding to a stepping amount of the pedal; and a damper which applies a resistance forces against rotation of the pedal to the pedal during the rotation toward at least one of a first direction in which the pedal is stepped to rotate and a second direction opposite to the first direction.

BRIEF DESCRIPTION OF THE DRAWINGS

FIG. 11(*a*) illustrates an initial state of the first pedal, and FIG. 11(*b*) illustrates a stepping state of the first pedal.

FIG. 12(*a*) illustrates the initial state of the third pedal, FIG. 12(*b*) illustrates a specified state of the third pedal, and FIG. 12(*c*) illustrates the stepping state of the third pedal.

DESCRIPTION OF THE EMBODIMENTS

Figure 1:
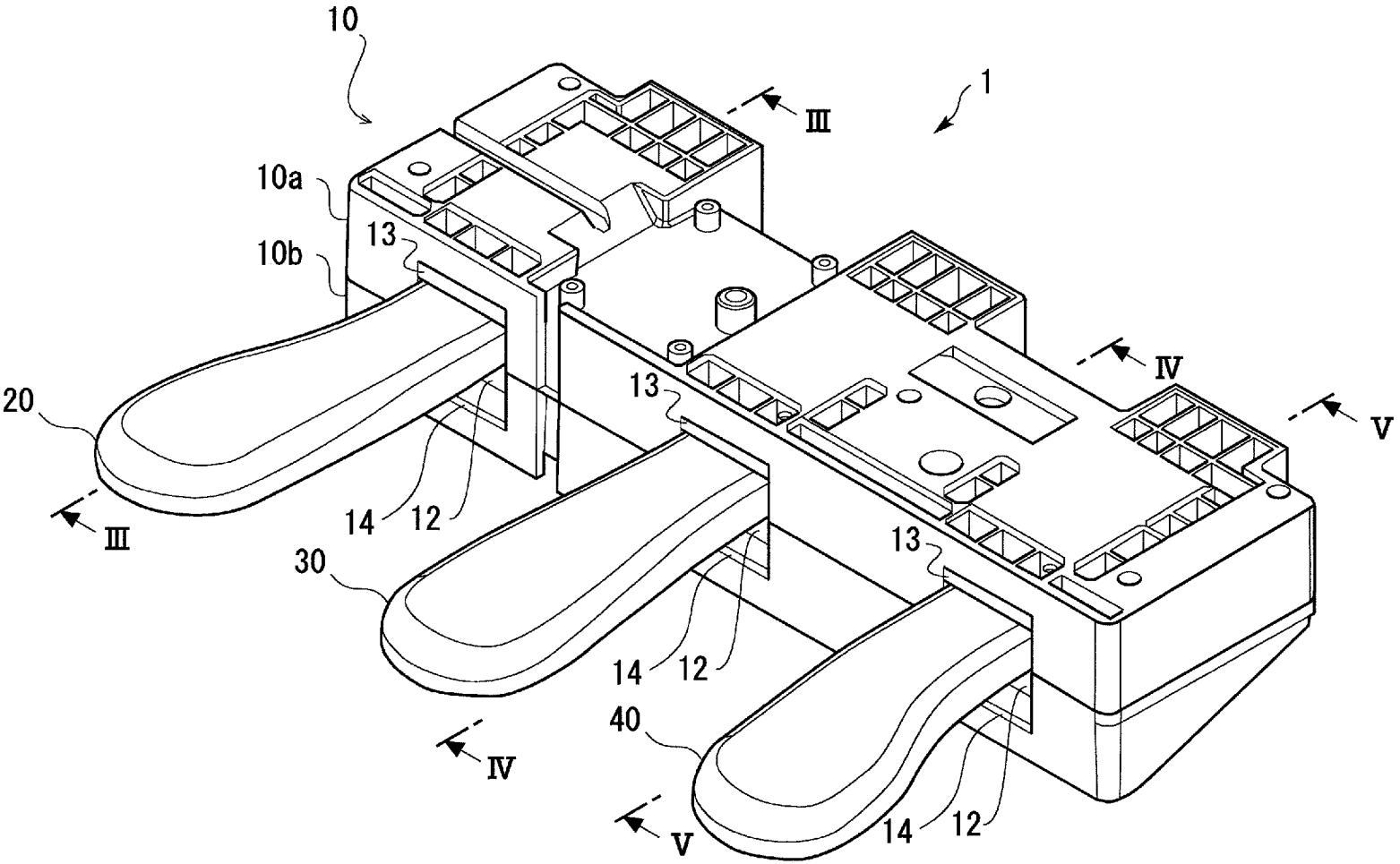
FIG. 1 is an overall perspective view of a pedal device of electronic keyboard instrument according to an embodiment.

The disclosure is accomplished to solve the problem described above and provides a pedal device of electronic keyboard instrument which can maintain an operation feeling similar to pedals of an acoustic piano for a long period.

According to the disclosure, in the stepping operation of the pedal, an operation loads during the rotation of the pedal toward the second direction, that is, an operation load in a return stroke can be smaller than the operation load during the rotation toward the first direction, that is, the operation load in a forward stroke. More specifically, when the damper applies the resistance force during the rotation of the pedal toward the second direction, a pedal load in the return stroke is reduced. Conversely, when the damper applies the resistance force during the rotation of the pedal toward the first direction, the pedal load in the forward stroke is increased. In addition, when the damper applies the resistance force during both the rotation of the pedal toward the first direction and the rotation of the pedal toward the second direction, the pedal load in the return stroke is reduced, and the pedal load in the forward stroke is increased. In any case, the operation load in the return stroke of the stepping operation can be smaller than the operation load in the forward stroke. As a result, a hysteresis characteristic the same as pedals of an acoustic piano can be applied to the operation load, and the operation feeling similar to the pedals of the acoustic piano can be achieved. Furthermore, when a predetermined member is pressed against the pedal, and a resistance force against the rotation is applied to the pedal by a friction force between the pedal and the member which is generated during the rotation of the pedal, a problem below is generated. That is, because the pedal and the member are worn due to the friction force in the part where the pedal and the member are in contact with each other, a desired load characteristic cannot be obtained for a long period. On the other hand, the disclosure is configured to apply the resistance force to the pedal by a damper with high durability, and thus generation of the above problem can be suppressed, and the desired load characteristic can be obtained for a long period. As a result, an operation feeling similar to a damper pedal of an acoustic piano can be maintained for a long period.

In addition, the damper may apply to the pedal the resistance force against the rotation of the pedal during the rotation of the pedal toward the second direction. In this way, in the forward stroke, the damper does not contribute to the operation load, and the operation load is reduced by the damper in the return stroke. Therefore, an existing coil spring or the like designed to obtain a predetermined load characteristic in the forward stroke can be diverted as the urging unit.

In addition, the damper may have a body portion fixed to the chassis, and a displacement portion capable of performing a predetermined relative displacement with respect to the body portion; the pedal device may include an engagement unit which engages with the pedal and the displacement portion and operates in conjunction with the rotation of the pedal to make the displacement portion carry out the predetermined relative displacement with respect to the body portion; and the damper may apply the resistance force against the relative displacement of the displacement portion from the body portion to the displacement portion during the relative displacement of the displacement portion with respect to the body portion. In this way, the resistance force against the rotation of the pedal can be applied to the pedal in conjunction with the rotation of the pedal.

Furthermore, the damper may be a rotary damper in which the displacement portion relatively rotates with respect to the body portion and thereby the body portion applies the resistance force to the displacement portion, and a rotation axis of the displacement portion may be arranged to be parallel to a rotation axis of the pedal. In this way, because the rotary damper is laid down, the pedal device can be suppressed from being bulky vertically.

However, the predetermined relative displacement in the damper according to the disclosure can also be translational motion instead of rotation. For example, the damper may not be the rotary damper but a configuration like a cylinder damper in which a resistance force against the translational motion of the displacement portion is applied from the body portion to the displacement portion by the displacement portion translating with respect to the body portion.

In addition, the engagement unit may have a slide shaft portion which is arranged on one of the displacement portion and the pedal and arranged eccentrically with the rotation axis of the displacement portion, and a guide hole which is arranged on the other of the displacement portion and the pedal and accepts the slide shaft portion, and the slide shaft portion may revolve around the rotation axis of the displacement portion in conjunction with the rotation of the pedal and slides along an inner wall of the guide hole, and thereby the displacement portion rotates with respect to the body portion. In this way, the configuration in which the resistance force against the rotation is applied to the pedal in conjunction with the rotation of the pedal can be achieved with a simple structure.

In addition, the first urging unit may be arranged closer to an operation position to be stepped by a performer than the rotation axis of the pedal, and the engagement unit may be arranged between the rotation axis of the pedal and the first urging unit. If a stroke of the slide shaft portion or the guide hole arranged at a pedal side is large, it is necessary to increase an amount of eccentricity of the slide shaft portion or the guide hole arranged at a displacement portion side, and thus an arrangement position of the engagement unit may be closer to the rotation axis of the pedal. On the other hand, with regard to the first urging unit, the closer to the rotation axis of the pedal, the larger the urging force required for obtaining the predetermined operation load is, and an increase in size of the first urging unit is required, and thus the arrangement position of the first urging unit may be farther away from the rotation axis of the pedal. By arranging the engagement unit closer to the rotation axis of the pedal than the first urging unit, size increasing of the engagement unit and the first urging unit caused by a positional relationship between the engagement unit and the first urging unit can be suppressed.

In addition, the disclosure may further include a second urging unit which is compressed when the stepping amount of the pedal exceeds a specified amount and urges the pedal in the second direction by an elastic force. Accordingly, the operation load of the pedal can be changed stepwise corresponding to the stepping amount, and the operation feeling similar to the damper pedal of the acoustic piano can be achieved.

Figure 2:
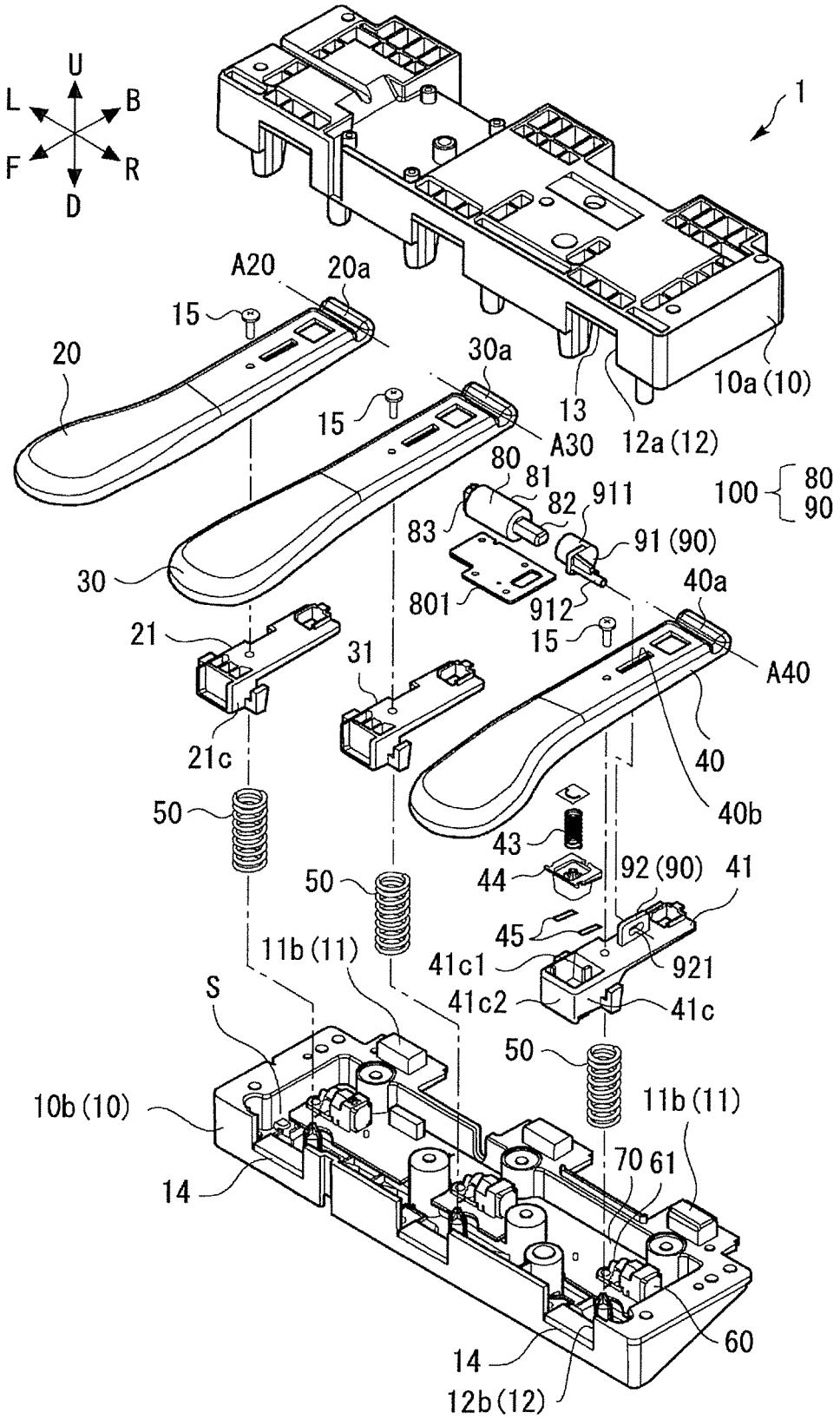
FIG. 2 is an exploded perspective view of the pedal device of electronic keyboard instrument according to the embodiment.
Figure 3:
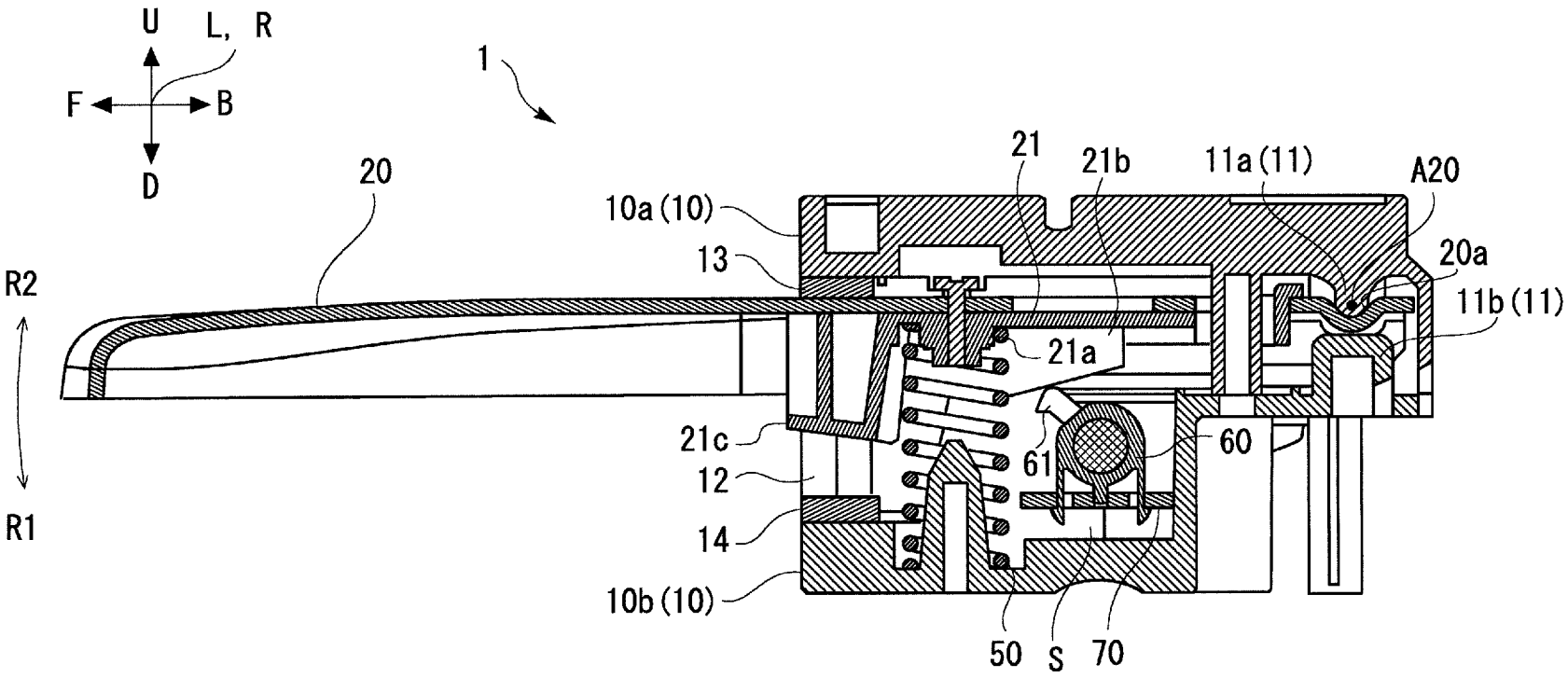
FIG. 3 is a cross-sectional view of the pedal device of electronic keyboard instrument along a III-III line in FIG. 1.
Figure 4:
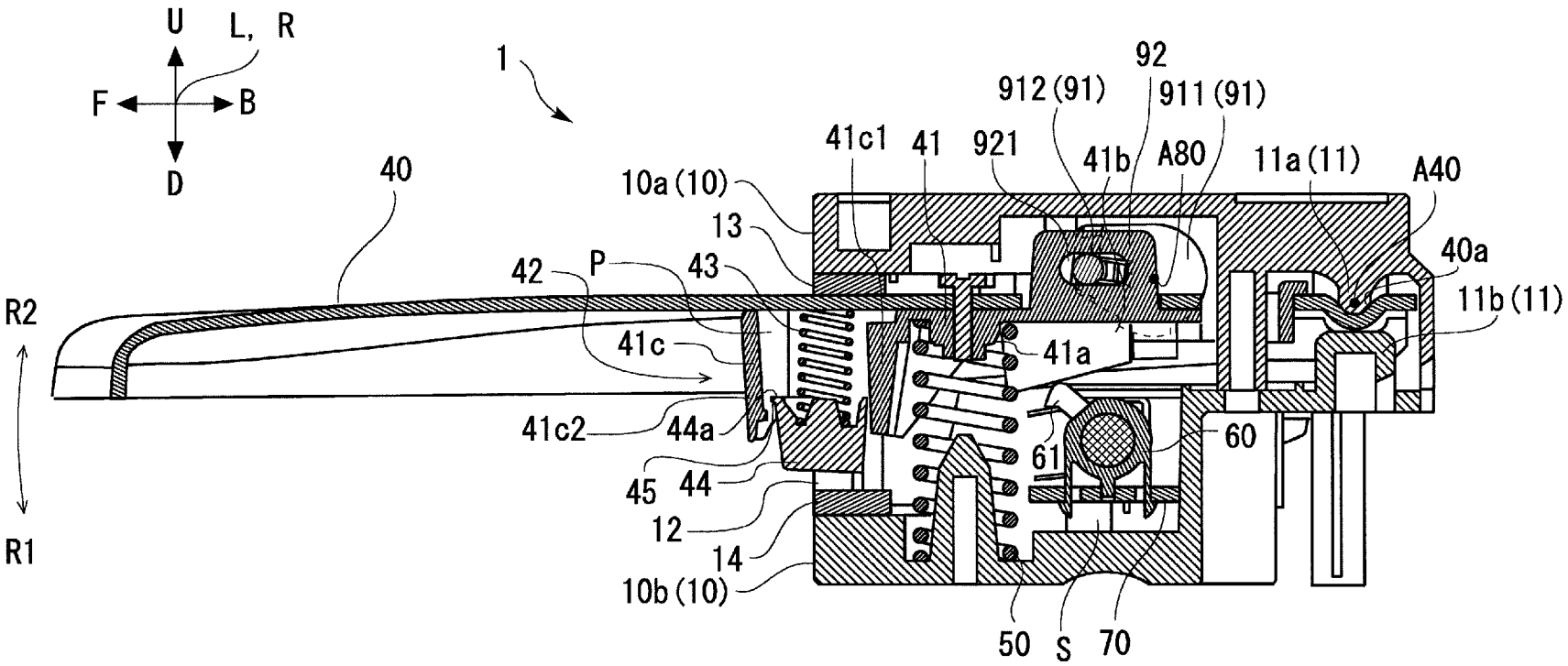
FIG. 4 is a cross-sectional view of the pedal device of electronic keyboard instrument along a IV-IV line in FIG. 1.
Figure 5:
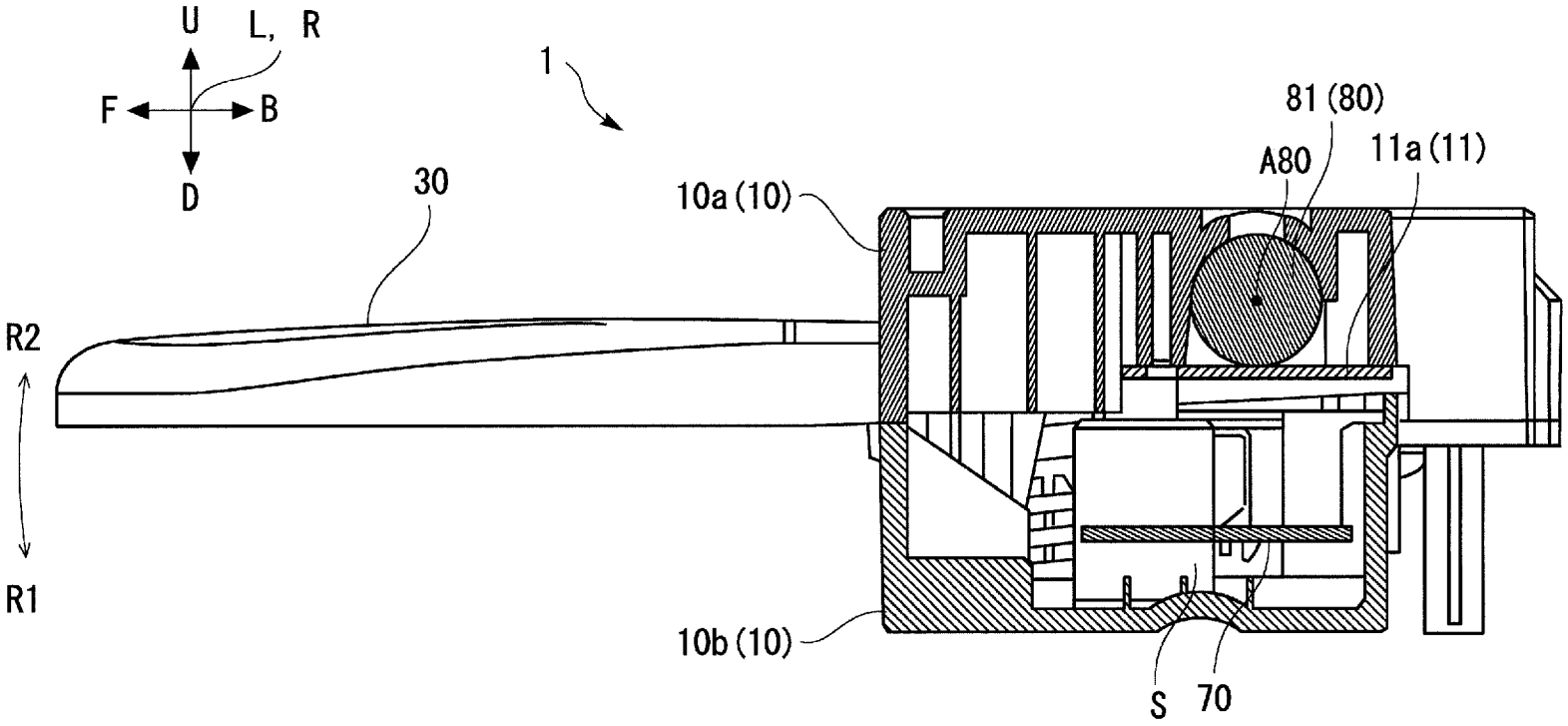
FIG. 5 is a cross-sectional view of the pedal device of electronic keyboard instrument along a V-V line in FIG. 1.

A pedal device of electronic keyboard instrument according to an embodiment is described below with reference to drawings. FIG. 1 is an overall perspective view of a pedal device of electronic keyboard instrument 1 according to the embodiment. FIG. 2 is an exploded perspective view of the pedal device of electronic keyboard instrument 1 according to the embodiment. FIG. 3 is a cross-sectional view of the pedal device 1 along a III-III line in FIG. 1, FIG. 4 is a cross-sectional view of the pedal device 1 along a IV-IV line in FIG. 1, and FIG. 5 is a cross-sectional view of the pedal device 1 along a V-V line in FIG. 1. In addition, FIG. 6(*a*) is a bottom perspective view of a first pedal 20, and FIG. 6(*b*) is a bottom perspective view of a third pedal 40. Besides, arrows U-D, L-R, F-B in the diagrams respectively show, an up-down direction, a left-right direction, and a front-back direction of the pedal device of electronic keyboard instrument 1.

<Configuration>

At first, an overall configuration of the pedal device of electronic keyboard instrument 1 (hereinafter, simply referred to as "pedal device 1") according to the embodiment is described with reference to FIG. 1 and FIG. 2. The pedal device 1 is a device used in an electronic keyboard instrument (not illustrated) such as an electronic piano or the like and gives various sound effects to a musical sound generated by the electronic keyboard instrument. The pedal device 1 mainly includes a chassis 10 forming a body, and a first pedal 20, a second pedal 30, and a third pedal 40 which are arranged in parallel in a left-right direction of the chassis 10. The pedal device 1 outputs, when the first pedal 20, the second pedal 30 and the third pedal 40 are respectively stepped by a performer, voltage values corresponding to the stepping amounts to the electronic keyboard instrument. In this way, in the pedal device 1, the pedals 20, 30, 40 respectively give sound effects the same as a soft pedal, a sostenuto pedal and a damper pedal of the acoustic piano to the musical sound of the electronic keyboard instrument.

The chassis 10 includes an upper chassis 10*a* and a lower chassis 10*b* which are made of a resin material such as ABS resin or the like. By vertically assembling the upper chassis 10*a* and the lower chassis 10*b* in an overlapping manner, the chassis 10 is formed into a hollow box-shape having an internal space S for assembling first springs 50, sensors 60 and circuit boards 70. Besides, connection cables (not illustrated) for connecting the pedal device 1 to the electronic keyboard instrument extend out from the circuit boards 70.

The first pedal 20, the second pedal 30 and the third pedal 40 correspond to the soft pedal, the sostenuto pedal and the damper pedal in the acoustic piano. Each of the pedals 20, 30, 40 is formed in a long plate shape by a metal material such as brass, iron or the like and is arranged to be elongated in a front-back direction. As shown in FIG. 1 and FIG. 2, a rear end portion side of each of the pedals 20, 30, 40 is supported by the chassis 10 and a front end portion side is exposed in front of the chassis 10. In each of the pedals 20, 30, 40, a supported position supported by the chassis 10 is positioned on the rear end portion side, and an operation position stepped by the performer is positioned in the front end portion side. Each of the pedals 20, 30, 40 is rotatable, by being stepped by the performer in the operation position on the front end portion side, taking the supported position of the rear end portion side supported by the chassis 10 as a fulcrum in a range in which the front end portion moves up and down between an upper limit position and a lower limit position.

Symbols A20, A30, A40 shown in FIG. 2 respectively indicate a rotation axis of each of the pedals 20, 30, 40. As shown in FIG. 2, the rotation axes A20, A30, A40 are disposed parallel to a left-right direction. Herein, a state before each of the pedals 20, 30, 40 is stepped (see FIG. 11(*a*) and FIG. 12(*a*)) is called an initial state. That is, when each of the pedals 20, 30, 40 is in the initial state, the stepping amount is 0, and the front end portion of each of the pedals 20, 30, 40 is in the upper limit position. Each of the pedals 20, 30, 40 rotates in a manner that the front end portion is lowered by being stepped. Then, if the stepping amount reaches an upper limit value, the front end portion of each of the pedals 20, 30, 40 reaches the lower limit position (see FIG. 11(*b*) and FIG. 12(*c*)). The state in which the front end portion of each of the pedals 20, 30, 40 is in the lower limit position is called a maximum stepping state. In addition, each of the pedals 20, 30, 40 is urged by a first spring 50 described later in a direction to return back to the initial state and is returned back from the maximum stepping state to the initial state by rotating in a manner that the front end portion is raised after the stepping is released. During the stepping operations, a stroke in which the front end portion of each of the pedals 20, 30, 40 is lowered is called a forward stroke, and a stroke in which the front end portion is raised is called a return stroke. In addition, with regard to rotation directions around the rotation axes A20, A30, A40 of each of the pedals 20, 30, 40, a direction in which each of the pedals 20, 30, 40 rotates in a manner that the front end portion is lowered in the forward stroke is called a first direction R1. Conversely, a direction opposite to the first direction R1, that is, a direction in which each of the pedals 20, 30, 40 rotates in a manner that the front end portion is raised in the return stroke is called a second direction R2. In FIG. 3-FIG. 5, the first direction R1 and second direction R2 are shown.

As shown in FIG. 2, the first springs 50 are disposed below each of the pedals 20, 30, 40. The first springs 50 apply the urging forces which intend to make each of the pedals 20, 30, 40 rotate toward the second direction R2 to each of the pedals 20, 30, 40 corresponding to the stepping amount of each of the pedals 20, 30, 40, and are made of coil-shaped compression springs. The first springs 50 are erected below each of the pedals 20, 30, 40 in a manner that an expansion and contraction direction coincides with the up-down direction and are held between the chassis 10 and each of the pedals 20, 30, 40 in a pre-compressed (pressurized) state. By being compressed along with the stepping operation of each of the pedals 20, 30, 40, the first springs 50 apply, to each of the pedals 20, 30, 40, the urging forces corresponding to the stepping amounts (hereinafter referred to as "first urging forces") by the elastic forces. The urging forces function as reaction forces against the stepping during the stepping operations. The first springs 50 are exceptional examples of "first urging unit".

In addition, the sensors 60 are disposed below each of the pedals 20, 30, 40. More specifically, the sensors 60 are mounted on the circuit boards 70 disposed below each of the pedals 20, 30, 40 and are respectively arranged at three positions corresponding to the arrangement of each of the pedals 20, 30, 40. The sensors 60 detect the stepping amount of each of the pedals 20, 30, 40 and output a resistance value corresponding to the stepping amount. The sensors 60 include lever portions 61 rotating along with the stepping operation of each of the pedals 20, 30, 40, and variable resistors (not illustrated) for outputting resistance values corresponding to rotation amounts of the lever portions 61, that is, the stepping amount of each of the pedals 20, 30, 40. By outputting the resistance values corresponding to the stepping amount of each of the pedals 20, 30, 40 from the sensors 60, the voltage values corresponding to the resistance value are output via the connection cables (not illustrated) to the electronic keyboard instrument. As a result, the sound effects corresponding to the stepping amount of each of the pedals 20, 30, 40 are given to the musical sound of the electronic keyboard instrument.

As shown in FIG. 2-FIG. 5, on a rear side of the internal space S of the chassis 10, supporting portions 11 are arranged at three positions respectively corresponding to the arrangement of the first pedal 20, the second pedal 30 and the third pedal 40. The supporting portions 11 are portions for supporting each of the pedals 20, 30, 40 and are configured by convex upper supporting portions 11*a* formed on the upper chassis 10*a* and lower supporting portions 11*b* formed on the lower chassis 10*b*.

In addition, in a front surface of the chassis 10, opening portions 12 are arranged at three positions respectively corresponding to the arrangement of the first pedal 20, the second pedal 30 and the third pedal 40. The opening portions 12 are portions for exposing a front end portion of each of the pedals 20, 30, 40 on a front side of the chassis 10. The opening portions 12 are configured by upper opening portions 12*a* with an appropriately rectangular shape in a front view opened and formed in the upper chassis 10*a* and lower opening portions 12*b* with an appropriately rectangular shape in a front view opened and formed in the lower chassis 10*b*. In addition, cushions 13, 14 are attached to upper surfaces and lower surfaces of the opening portions 12. The cushions 13, 14 are members for regulating the rotation of each of the pedals 20, 30, 40 and are made of a shock absorbing material such as felt, urethane foam or the like. Each of the pedals 20, 30, 40 abuts against the cushion 13, and thereby further rotation of each of the pedals 20, 30, 40 toward the second direction is regulated. In addition, each of the pedals 20, 30, 40 abuts against the cushion 14, and thereby further rotation of each of the pedals 20, 30, 40 toward the first direction is regulated. In this way, the upper limit position and the lower limit position of each of the pedals 20, 30, 40 are determined. In addition, because shocks generated when each of the pedals 20, 30, 40 abuts against the cushions 13, 14 are mitigated by the cushions 13, 14 themselves, generation of shock noise is suppressed.

As shown in FIG. 2, on upper surfaces of rear end portions of the first pedal 20, the second pedal 30 and the third pedal 40, groove portions 20*a*, 30*a*, 40*a* are formed along a width direction (the left-right direction). The groove portions 20*a*, 30*a*, 40*a* are portions supported by the supporting portions 11 of the chassis 10 and are formed as depressions having an appropriately U-shaped cross section. The upper supporting portions 11*a* of the upper chassis 10*a* are accommodated in grooves where the groove portions 20*a*, 30*a*, 40*a* are formed. The groove portions 20*a*, 30*a*, 40*a* are clamped by the upper supporting portions 11*a* and the lower supporting portions 11*b* of the chassis 10, and thereby each of the pedals 20, 30, 40 is rotatably supported in a cantilever state on the chassis 10 taking the groove portions 20*a*, 30*a*, 40*a* as fulcrums. In this way, the rotation axes A20, A30, A40 of each of the pedals 20, 30, 40 are respectively formed.

In addition, as shown in FIG. 3 and FIG. 4, actuators 21, 31, 41 are detachably mounted by screws 15 to areas accommodated in the internal space S of the chassis 10, the areas being lower surfaces of the pedals 20, 30, 40. The actuators 21, 31, 41 transmit the stepping amounts of the pedals 20, 30, 40 to the sensors 60 and regulate the stepping amounts, and the actuators 21, 31, 41 are formed into a long plate shape from a resin material such as polyacetal resin or the like.

Specific configurations of the actuators 21, 31, 41 are described below. Besides, the actuator 31 has the same configuration as the actuator 21, and thus description of the specific configuration of the actuator 31 is omitted.

Figure 6A:
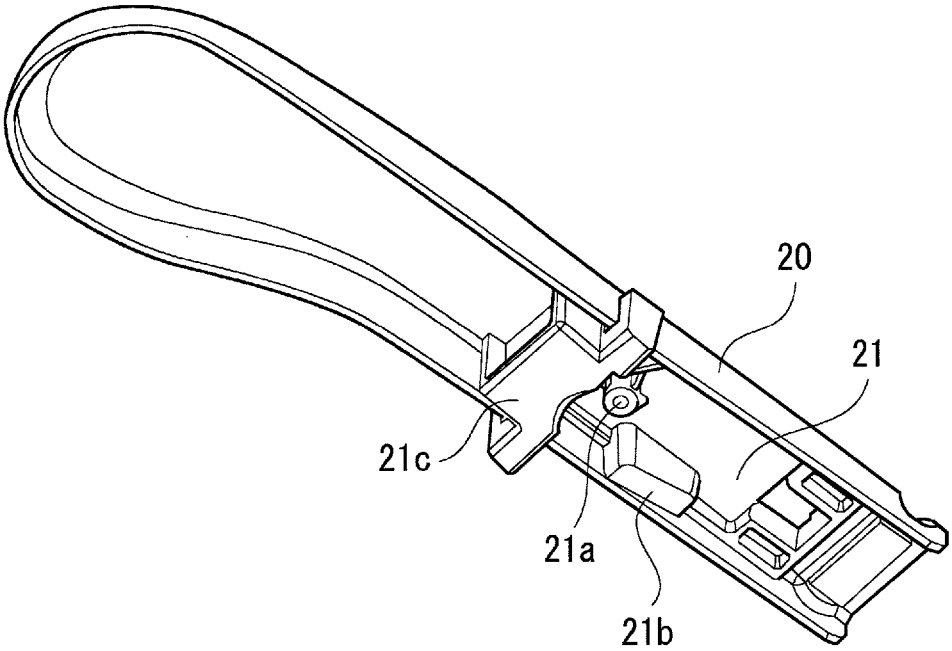
FIG. 6(*a*) is a bottom perspective view of a first pedal, and FIG. 6(*b*) is a bottom perspective view of a third pedal.
Figure 6B:
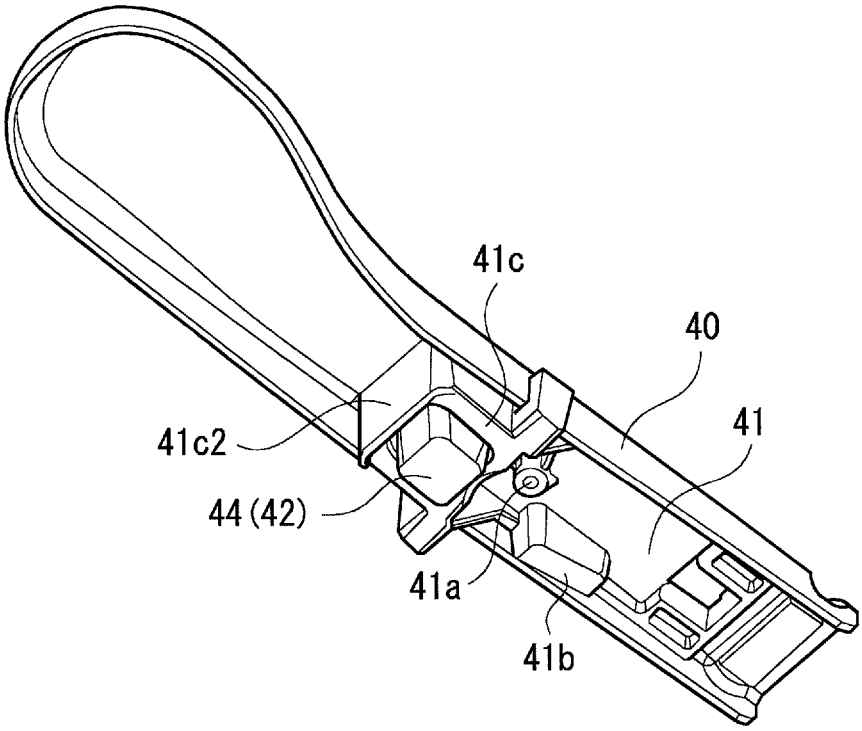

First, the actuator 21 is described. As shown in FIG. 3 and FIG. 6(*a*), a holding portion 21*a*, a transmission portion 21*b* and a stopper portion 21*c* are arranged on a lower surface of the actuator 21. The holding portion 21*a* is a portion for holding the first spring 50 and protrudes approximately in the centre of the actuator 21 in the front-back direction. A first urging force by the first spring 50 is applied to the first pedal 20 in the holding portion 21*a*.

The transmission portion 21*b* is a portion for transmitting the stepping amount of the first pedal 20 to the sensor 60 and protrudes in a position facing the lever portion 61 of the sensor 60. The transmission portion 21*b* transmits the stepping amount of the first pedal 20 to the sensor 60 by pressing the lever portion 61 of the sensor 60 during the stepping operation of the first pedal 20. As a result, a voltage value corresponding to the stepping amount of the first pedal 20 is output to the electronic keyboard instrument.

The stopper portion 21*c* is a portion for regulating the stepping amount of the first pedal 20 and protrudes in a position facing the cushion 14 which is a front end portion of the actuator 21. The stopper portion 21*c* abuts against the cushion 14, and thereby the rotation of the first pedal 20 toward the first direction R1 is regulated, and the lower limit position of the first pedal 20 is determined. In this way, an upper limit of the stepping amount of the first pedal 20 is determined.

Next, the actuator 41 is described. As shown in FIG. 4 and FIG. 6(*b*), a holding portion 41*a*, a transmission portion 41*b* and a stopper portion 41*c* are arranged on a lower surface of the actuator 41. The holding portion 41*a* is a portion for holding the first spring 50 and is formed in an approximately central portion of the actuator 41. A first urging force by the first spring 50 is applied to the third pedal 40 in the holding portion 41*a*.

The transmission portion 41*b* is a portion for transmitting the stepping amount of the third pedal 40 to the sensor 60 and protrudes in a position facing the lever portion 61 of the sensor 60. The transmission portion 41*b* transmits the stepping amount of the third pedal 40 to the sensor 60 by pressing the lever portion 61 of the sensor 60 along with the stepping operation of the third pedal 40. As a result, a voltage value corresponding to the stepping amount of the third pedal 40 is output to the electronic keyboard instrument.

The stopper portion 41*c* is a portion for regulating the stepping amount of the third pedal 40 and protrudes in a position facing the cushion 14 which is a front end portion of the actuator 41. The stopper portion 41*c* abuts against the cushion 14, and thereby the rotation of the third pedal 40 toward the first direction R1 is regulated, and the lower limit position of the third pedal 40 is determined. In this way, an upper limit of the stepping amount of the third pedal 40 is determined. In addition, the stopper portion 41*c* has a hollow shape in which a central portion of a lower surface is open in order to form an internal space P for incorporating a second urging force application mechanism 42.

The second urging force application mechanism 42 is a mechanism for changing the operation load of the third pedal 40 in the stepping operation during the stepping and includes a second spring 43 and a movable stopper 44. The second urging force application mechanism 42 is mounted to the third pedal 40 integrally with the actuator 41 by being incorporated in the internal space P of the stopper portion 41*c*. The second urging force application mechanism 42 is one example of a "second urging unit".

The second spring 43 is used to apply, when the stepping amount of the third pedal 40 exceeds a predetermined stepping amount (hereinafter referred to as "specified amount"), an urging force (hereinafter referred to as second urging force) intending to make the third pedal 40 rotate in the second direction R2 to the third pedal 40. Besides, the specified amount is set to be smaller than the upper limit value of the stepping amount. The second spring 43 is made of a coil-shaped compression spring and is erected in the internal space P in a manner that an expansion and contraction direction coincides with the up-down direction. More specifically, the second spring 43 is held between the third pedal 40 and the movable stopper 44 in a pre-compressed (pressurized) state. When the stepping amount of the third pedal 40 exceeds the specified amount, the second spring 43 is compressed along with the stepping of the third pedal 40, and thereby the second spring 43 applies the second urging force corresponding to the stepping amount by the elastic force to the third pedal 40. The urging force acts as a reaction force against the stepping in the stepping operation.

The movable stopper 44 holds the second spring 43 and is made of a resin material such as ABS resin into a hollow shape in which an upper surface is open. The movable stopper 44 protrudes below a lower surface of the stopper portion 41*c* by being urged by the second spring 43 in the initial state. The movable stopper 44 abuts against the cushion 14 when the stepping amount of the third pedal 40 reaches the specified amount, and enters the internal space P of the stopper portion 41*c* while compressing the second spring 43 when the third pedal 40 exceeds the specified amount and is further stepped. When the third pedal 40 exceeds the specified amount and is further stepped, the second spring 43 is accommodated inside the movable stopper 44.

On an upper edge portion of the movable stopper 44, a flange portion 44*a* is arranged. The flange portion 44*a* is a portion for regulating a lower limit position of the movable stopper 44 and is formed to project in the front, back, left and right. By the flange portion 44*a* abutting against an inner side bottom surface of the stopper portion 41*c*, downward movement of the movable stopper 44 is regulated, and the lower limit position is regulated. In addition, a cushion 45 made of a shock absorbing material such as felt, urethane foam or the like is attached to the lower surface of the flange portion 44*a*. In the movable stopper 44, by the flange portion 44*a* abutting against the inner side bottom surface of the stopper portion 41*c* through the cushion 45, the shock is mitigated. In this way, the shock noise can be suppressed.

A guide portion 41*c*1 is arranged in the internal space P of the stopper portion 41*c*. The guide portion 41*c*1 is a portion for guiding the entering of the movable stopper 44 and is extended in an entering direction of the movable stopper 44. The movable stopper 44 enters the internal space P of the stopper portion 41*c* along the guide portion 41*c*1, and in this way the entering is guided. Accordingly, rattle of the movable stopper 44 is prevented, and the second spring 43 can be compressed with high accuracy.

In addition, in a front end portion of the stopper portion 41*c*, a cover portion 41*c*2 protrudes downward. The cover portion 41*c*2 is a portion for covering a front side of the movable stopper 44, and thereby an external appearance is improved and the movable stopper 44 are protected from external factors such as dust intrusion, finger insertion or the like.

Figure 7:
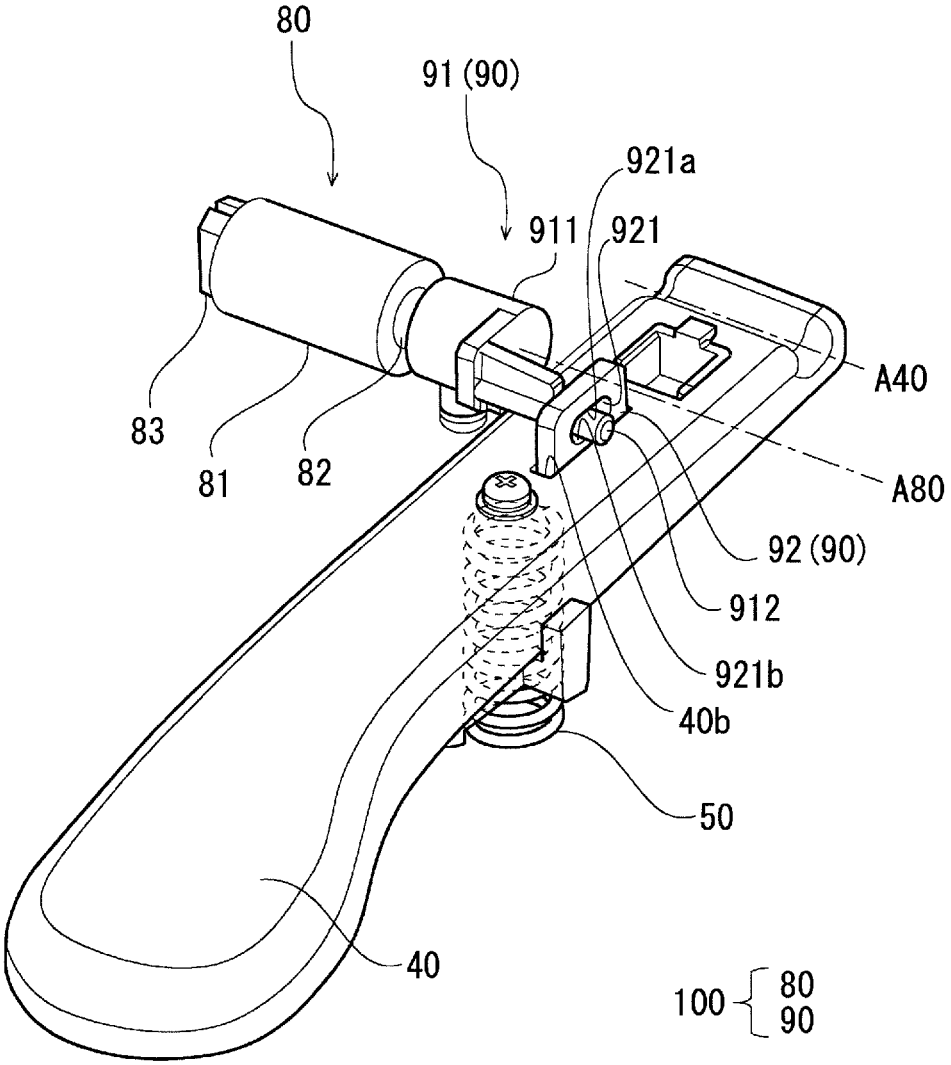
FIG. 7 is a perspective view showing a hysteresis application structure according to the embodiment.
Figure 8:
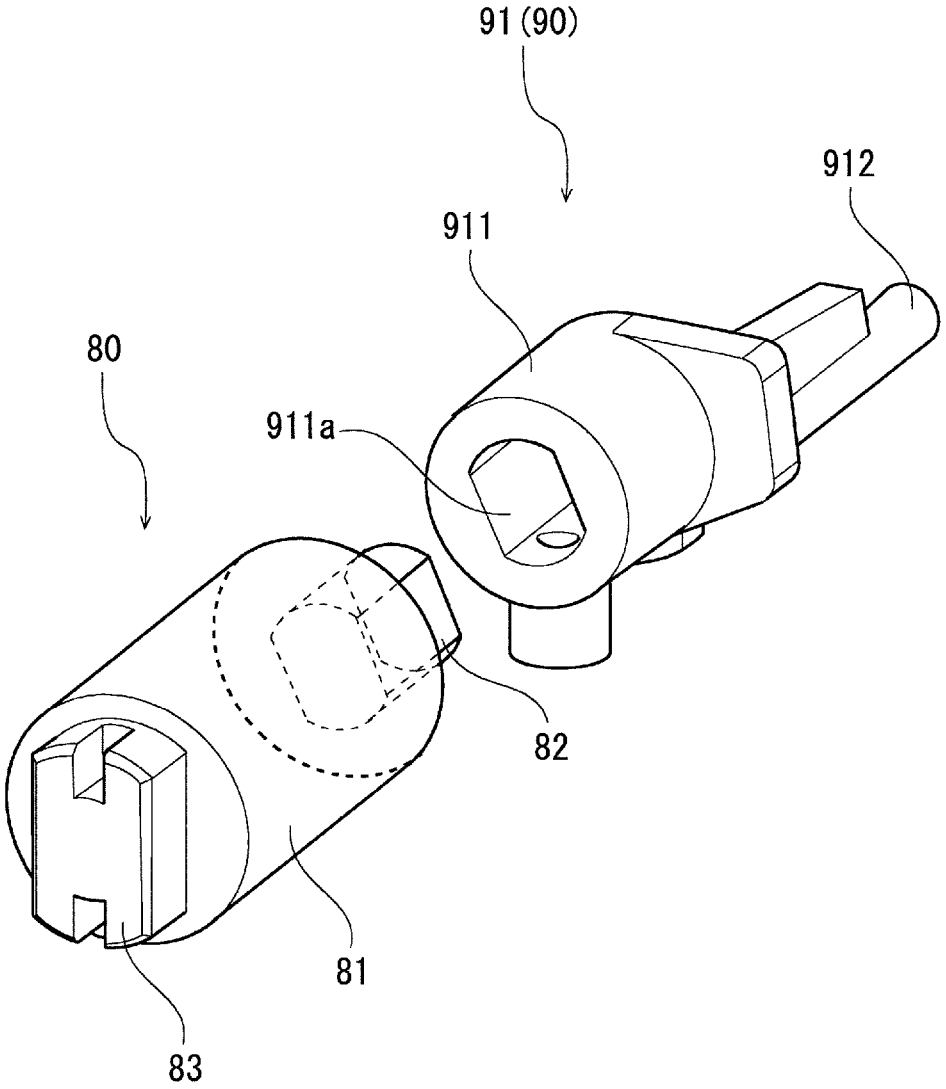
FIG. 8 is a diagram showing a relationship between a damper and a first engagement member.
Figure 9:
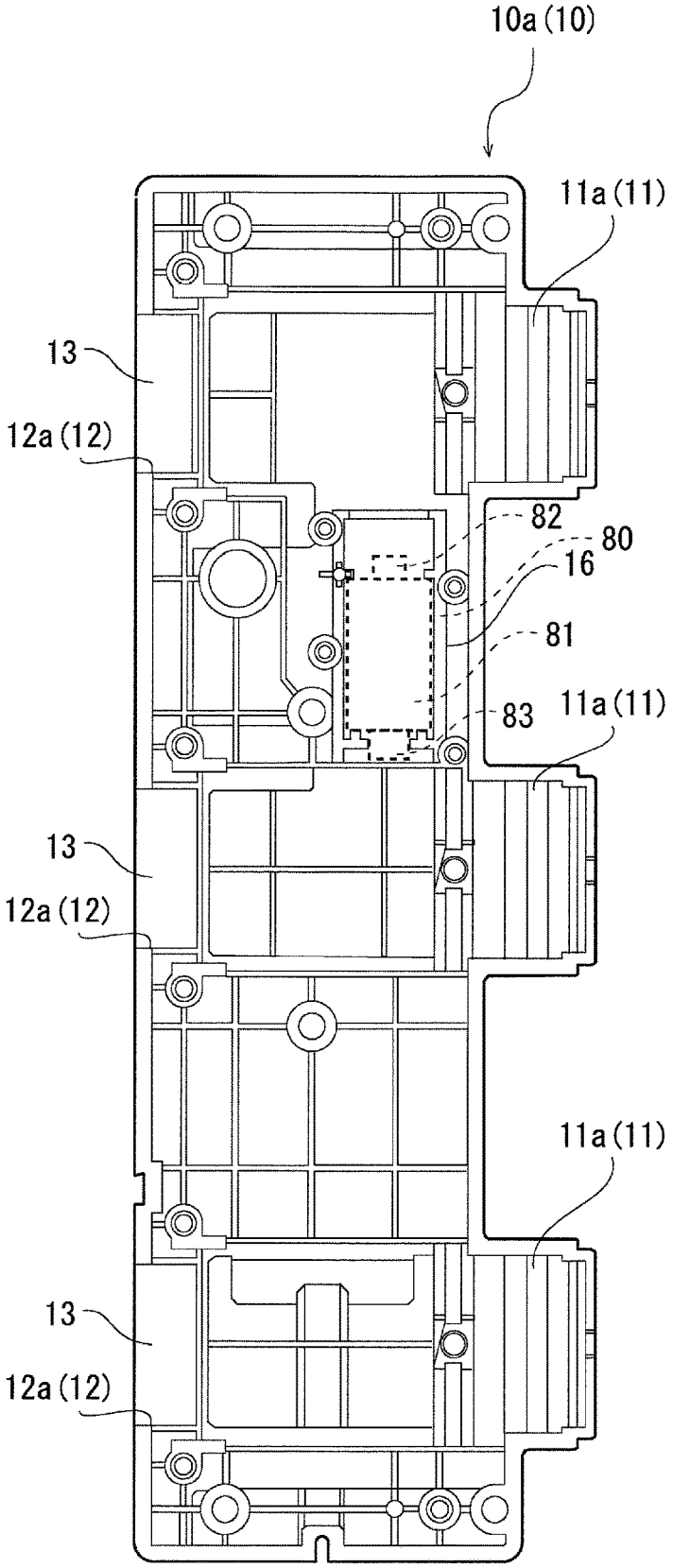
FIG. 9 is a bottom view of an upper chassis.

FIG. 7 is a perspective view showing a hysteresis application structure 100 according to an embodiment, FIG. 8 is a diagram showing a relationship between a damper 80 and a first engagement member 91, and FIG. 9 is a bottom view of the upper chassis 10*a*. In FIG. 9, the damper 80 is shown by a broken line. The pedal device 1 according to the embodiment includes a structure (hereinafter referred to as hysteresis application structure 100) for applying a hysteresis to the operation load acting on the third pedal 40 in the stepping operation. As shown in FIG. 7, the hysteresis application structure 100 includes the damper 80 and an engagement unit 90. In addition, the engagement unit 90 includes the first engagement member 91 disposed on the damper 80 side and a second engagement member 92 disposed on the third pedal 40 side. With reference to FIG. 2, FIG. 5, and FIG. 7-FIG. 9, the hysteresis application structure 100 included in the pedal device 1 is specifically described below.

The damper 80 is a rotary damper generating the resistance force opposite to the rotation direction of the third pedal 40 during the rotation of the third pedal 40. As shown in FIG. 2, the damper 80 is disposed between the second pedal 30 and the third pedal 40 and is connected to the third pedal 40 via the engagement unit 90. As shown in FIG. 8, the damper 80 has a body portion 81 with a cylindrical outline, a displacement portion 82 protruding on one end surface in an axial direction of the body portion 81, and a locked portion 83 protruding on the other end surface.

The body portion 81 is a portion which is fixed to the chassis 10 and applies the resistance force to the displacement portion 82. The displacement portion 82 is a portion capable of performing a predetermined relative displacement with respect to the body portion 81. In the example, the displacement portion 82 is arranged to be capable of the rotation as the predetermined relative displacement. A symbol A80 shown in FIG. 7 indicates a rotation axis of the displacement portion 82. The rotation axis A80 coincides with a central axis of the body portion 81. In addition, the displacement portion 82 has an appropriately rectangular shape in the cross section orthogonal to the rotation axis A80 and can be fitted into a first engagement member 913 of the first engagement member 91 described later.

The locked portion 83 is a portion regulating the rotation of the body portion 81 by being locked with the chassis 10. The locked portion 83 has an appropriately rectangular shape in the cross section orthogonal to a central axis of the body portion 81 and is formed integrally with the body portion 81.

As shown in FIG. 9, an accommodating portion 16 for accommodating and holding the damper 80 is arranged on a lower surface of the upper chassis 10*a*. The accommodating portion 16 has a hollow shape being open at the bottom and regulates movement of the body portion 81 in the front, back, left and right with respect to the chassis 10 by abutting against the body portion 81 from the front, back, left and right. In addition, the accommodating portion 16 regulates, by locking the locked portion 83 formed integrally with the body portion 81, the rotation of the body portion 81 with respect to the chassis 10. In addition, as shown in FIG. 2 and FIG. 5, a holder 801 having a plate shape is mounted to the accommodating portion 16 in a state of abutting against the body portion 81 from below, and thereby the body portion 81 is in a state of being clamped between the upper chassis 10*a* and the holder 801. In this way, the up and down movement of the body portion 81 with respect to the chassis 10 is regulated, and the body portion 81 is fixed with respect to the chassis 10. On the other hand, the displacement portion 82 is allowed to rotate around the rotation axis A80 with respect to the body portion 81. As shown in FIG. 2 and FIG. 7, the damper 80 is arranged on the chassis 10 in a manner that the rotation axis A80 is parallel to a rotation axis A40 of the third pedal 40.

Next, the engagement unit 90 is described. The engagement unit 90 is used to make, by engaging the third pedal 40 with the displacement portion 82, the displacement portion 82 perform the rotation as the predetermined relative displacement in conjunction with the rotation of the third pedal 40. As shown in FIG. 7, the engagement unit 90 includes the first engagement member 91 installed on the displacement portion 82 of the damper 80 and the second engagement member 92 protruding on the upper surfaces of the third pedal 40.

The first engagement member 91 has a connecting portion 911 with an approximately cylindrical outline. The first engagement member 91 is arranged in a manner that a central axis of the connecting portion 911 coincides with the rotation axis A80. As shown in FIG. 8, in an end surface of the connecting portion 911 on the displacement portion 82 side, a fitting hole 911*a* into which the displacement portion 82 can be fitted is drilled, and the first engagement member 91 is installed to the displacement portion 82 by fitting the displacement portion 82 into the connecting portion 911. At this time, because the displacement portion 82 has a rectangular cross section, the rotation of the first engagement member 91 with respect to the displacement portion 82 is regulated. Therefore, if the first engagement member 91 rotates around the rotation axis A80, along with this rotation, the displacement portion 82 also rotates around the rotation axis A80 in a direction the same as a rotation direction of the first engagement member 91.

In addition, the first engagement member 91 has a slide shaft portion 912 which protrudes on an end surface of the connecting portion 911 on the third pedal 40 side. The slide shaft portion 912 has a cylindrical outline. As shown in FIG. 7, a central axis of the slide shaft portion 912 and the rotation axis A80 are parallel to each other, and the slide shaft portion 912 is eccentrically arranged with respect to the rotation axis A80. Therefore, if the slide shaft portion 912 revolves around the rotation axis A80, along with this revolution, the first engagement member 91 and the displacement portion 82 rotate around the rotation axis A80 in a direction the same as a revolving direction of the slide shaft portion 912.

The second engagement member 92 has a plate shape orthogonal to the left-right direction and protrudes on the upper surface of the third pedal 40. The second engagement member 92 is formed on the upper surface of the actuator 41, and by mounting the actuator 41 to the lower surface of the third pedal 40, the second engagement member 92 is inserted through a penetration hole 40*b* formed in the third pedal 40 and projects on the upper surface of the third pedal 40. In the second engagement member 92, a guide hole 921 is arranged which accepts the slide shaft portion 912 and makes the slide shaft portion 912 revolve around the rotation axis A80 along with the rotation of the third pedal 40 around the rotation axis A40. The guide hole 921 is a penetration hole penetrating both the left surface and the right surface of the second engagement member 92 and is formed into a long hole lengthened in the front-rear direction of the third pedal 40. As shown in FIG. 7, an inner wall of the guide hole 921 includes an upper wall 921*a* and a lower wall 921*b* which are vertically opposed and parallel to each other. An interval dimension between the upper wall 921*a* and the lower wall 921*b*, that is, a width dimension of the guide hole 921 in the short direction is approximately equal to or slightly larger than a diameter dimension of the slide shaft portion 912. Accordingly, the slide shaft portion 912 can slide in the guide hole 921 in a longitudinal direction (a front-back direction).

Figure 10A:
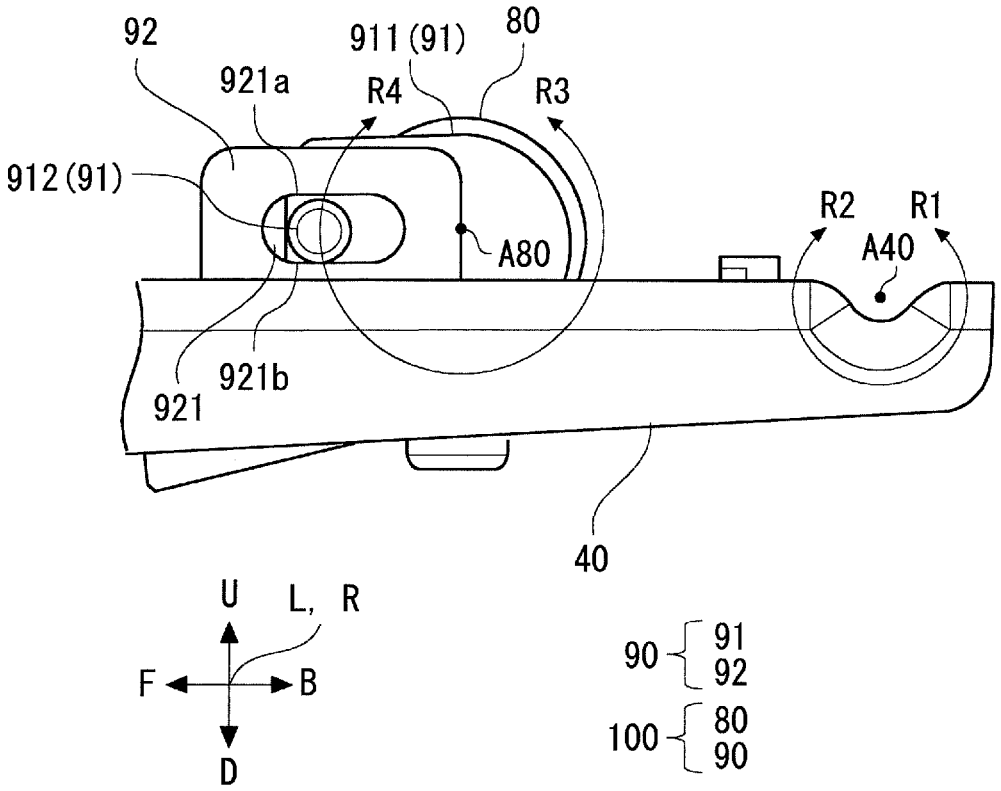
FIG. 10A is a diagram for describing a behavior of the hysteresis application structure when a third pedal rotates around a rotation axis and is a diagram showing a situation when the third pedal is in an initial state.
Figure 10B:
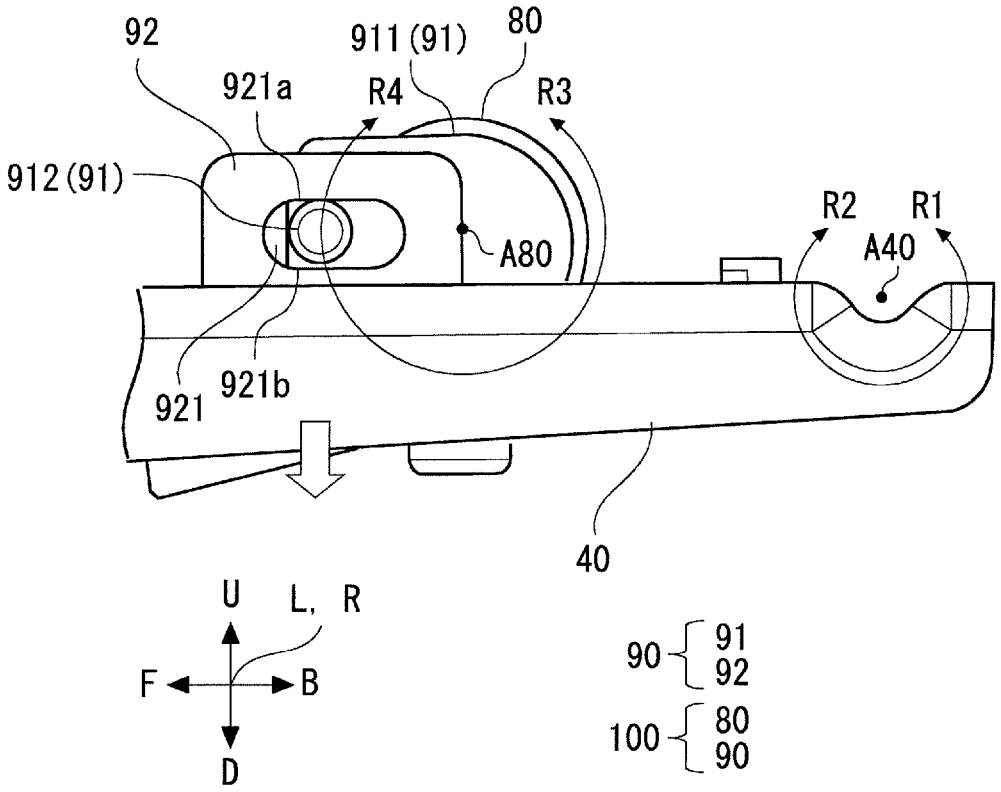
FIG. 10B is a diagram for describing a behavior of the hysteresis application structure when the third pedal rotates around the rotation axis and is a diagram showing a situation when the third pedal is in a forward stroke.
Figure 10C:
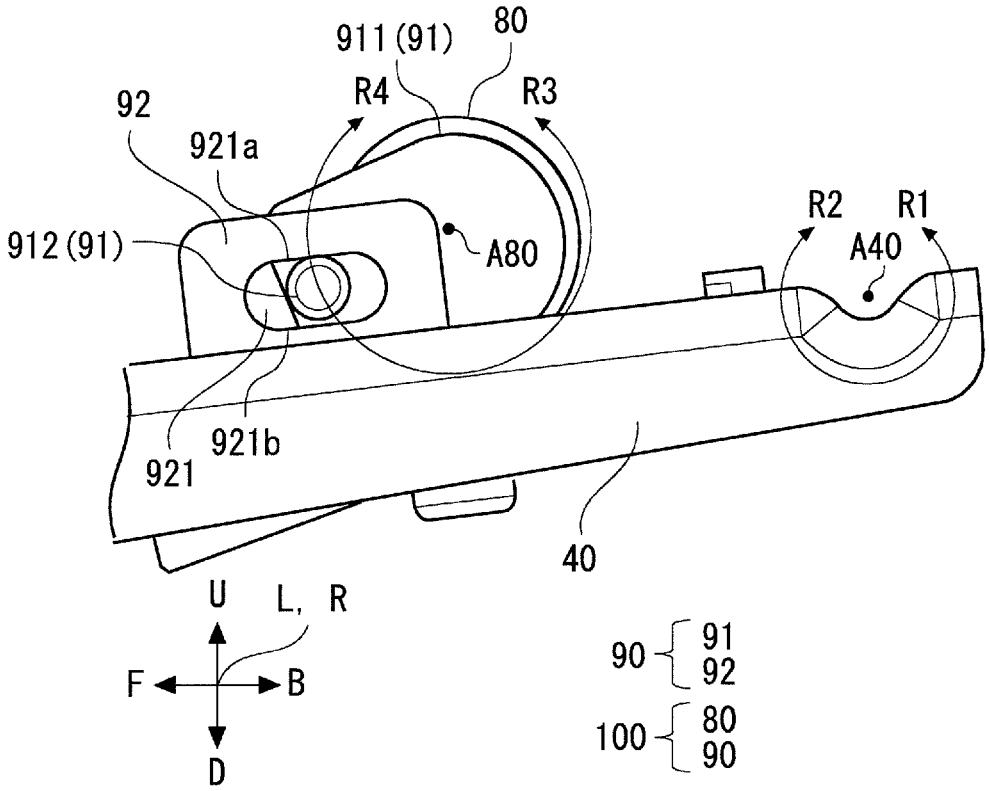
FIG. 10C is a diagram for describing a behavior of the hysteresis application structure when the third pedal rotates around the rotation axis and is a diagram showing a situation when the third pedal reached the maximum stepping state.
Figure 10D:
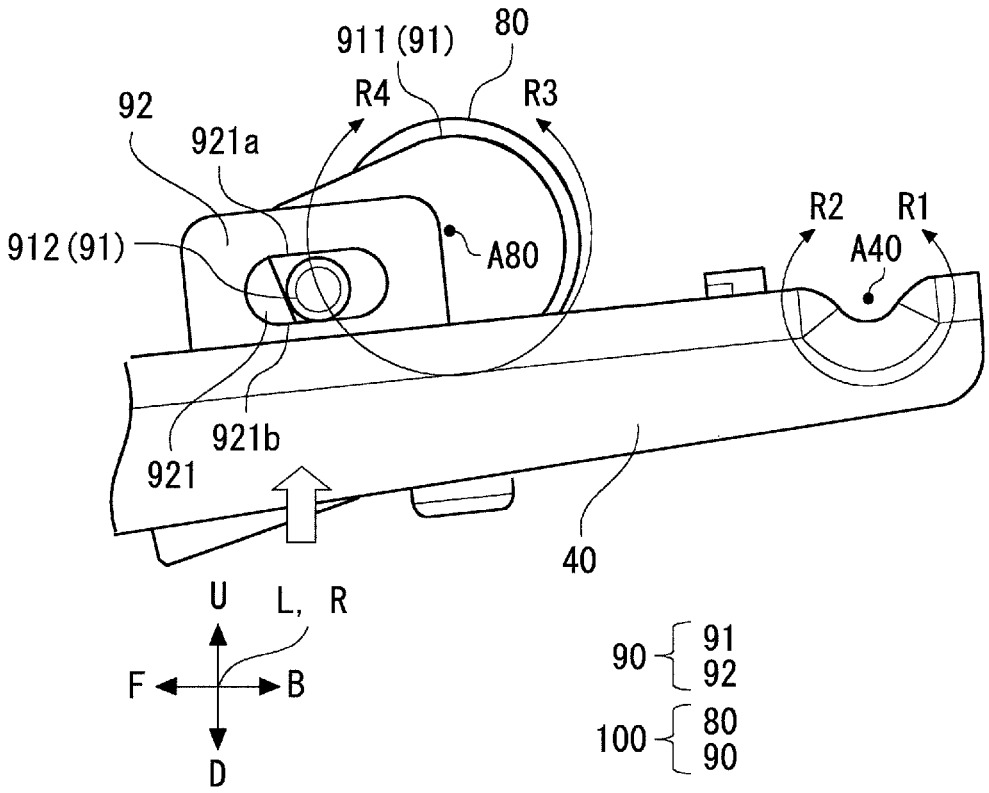
FIG. 10D is a diagram for describing a behavior of the hysteresis application structure when the third pedal rotates around the rotation axis and is a diagram showing a situation when the third pedal is in a return stroke.

Next, behavior of the hysteresis application structure 100 along with the stepping operation of the third pedal 40 are described. FIG. 10A-FIG. 10D are diagrams for describing the behavior of the hysteresis application structure 100 when the third pedal 40 rotates around the rotation axis A40. FIG. 10A shows a situation when the third pedal 40 is in the initial state, FIG. 10B shows a situation when the third pedal 40 is in the forward stroke, FIG. 10C shows a situation when the third pedal 40 reaches the maximum stepping state, and FIG. 10D shows a situation when the third pedal 40 is in the return stroke.

As shown in FIG. 10A, when the third pedal 40 is in the initial state, the slide shaft portion 912 is supported by the lower wall 921*b* of the guide hole 921. Accordingly, the first engagement member 91 is maintained in a posture in which the slide shaft portion 912 is positioned in front of the rotation axis A80 and at a height approximately the same as the rotation axis A80. Herein, with regard to the revolving direction of the slide shaft portion 912 around the rotation axis A80, that is, the rotation direction of the first engagement member 91 and the displacement portion 82 around the rotation axis A80, a direction in which the slide shaft portion 912 rotates so as to lower from the state shown in FIG. 10A is set as a third direction R3. In addition, an opposite direction, that is, a direction in which the slide shaft portion 912 rotates so as to rise from the state shown in FIG. 10C is set as a fourth direction R4. The third direction R3 and the fourth direction R4 are shown in FIG. 10A-FIG. 10D.

The stepping operation of the third pedal 40 starts from the state shown in FIG. 10A, and by the third pedal 40 rotating around the rotation axis A40 in the first direction, as shown in FIG. 10B, the upper wall 921*a* of the guide hole 921 presses against the slide shaft portion 912 from above. In this way, in the forward stroke of the third pedal 40, the slide shaft portion 912 revolves around the rotation axis A80 toward the third direction R3. Along with this revolution, the first engagement member 91 and the displacement portion 82 also rotate around the rotation axis A80 toward the third direction R3. In addition, the slide shaft portion 912 retracts while sliding along the upper wall 921*a* in the guide hole.

As shown in FIG. 10C, the third pedal 40 is in the maximum stepping state, and thereby the slide shaft portion 912 reaches a lower limit position. The position of the slide shaft portion 912 with respect to the rotation axis A80 at this time is in front of the rotation axis A80 and is lower than the rotation axis A80. In addition, the position of the slide shaft portion 912 with respect to the guide hole 921 at this time is the most retracted position in the guide hole.

As shown in FIG. 10D, in the return stroke of the third pedal 40, the third pedal 40 rotates around the rotation axis A40 toward the second direction R2, and thereby the lower wall 921*b* of the guide hole 921 presses against the slide shaft portion 912 from below. Accordingly, in the return stroke of the third pedal 40, the slide shaft portion 912 revolves around the rotation axis A80 toward the fourth direction R4. Along with this revolution, the first engagement member 91 and the displacement portion 82 also rotate around the rotation axis A80 toward the fourth direction R4. In addition, the slide shaft portion 912 advances in the guide hole while sliding on the lower wall 92*l* b. Then, when the return stroke of the third pedal 40 ends and the third pedal 40 returns back to the initial state, the state returns to the state shown in FIG. 10A.

As described above, the hysteresis application structure 100 can make the displacement portion 82 rotate in conjunction with the rotation of the third pedal 40 by the engagement unit 90 which engages the third pedal 40 with the displacement portion 82. Herein, the damper 80 according to the embodiment is a so-called one-way rotary damper. That is, the damper 80 has a configuration in which the body portion 81 applies resistance to the displacement portion 82 when the displacement portion 82 rotates toward the rotation direction (that is, the fourth direction R4 in the example) of the displacement portion 82 when the third pedal 40 rotates toward the second direction R2. The damper 80 having the aforementioned characteristic may be, for example, an oil type rotary damper which generates a resistance force utilizing the fluid resistance of oil held inside the body portion 81. However, the damper 80 may also be, for example, a fiction type rotary damper which generates a resistance force utilizing a frictional resistance between the body portion 81 and the displacement portion 82.

Accordingly, by the damper 80 applying the resistance force to the displacement portion 82 during the rotation of the third pedal 40 toward the second direction R2, the resistance force is transmitted to the third pedal 40 via the engagement unit 90 which connects the displacement portion 82 with the third pedal 40. More specifically, a resistance force against the rotation of the displacement portion 82 toward the fourth direction R4 is applied as the resistance force against the revolving toward the second direction R2 to the connecting portion 911 of the first engagement member 91 which is installed in the displacement portion 82. Then, the resistance force acts on the lower wall 921*b* of the guide hole 921 abutting against the connecting portion 911. In this way, the damper 80 can apply, in the return stroke of the third pedal 40, the resistance force against the rotation toward the second direction R2 to the third pedal 40.

Figure 11A:
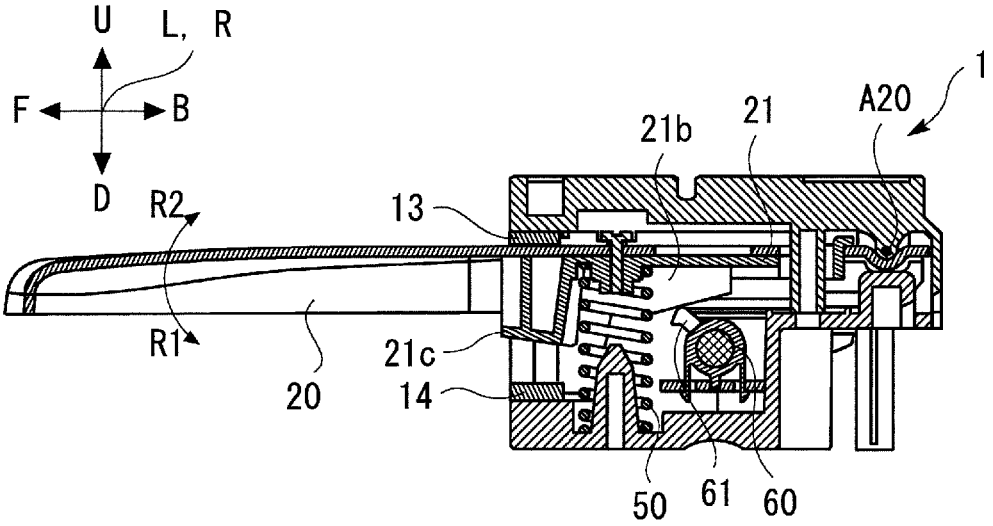
FIGS. 11(*a*) and 11(*b*) are cross-sectional views of the pedal device of electronic keyboard instrument along a III-III line in FIG. 1.
Figure 11B:
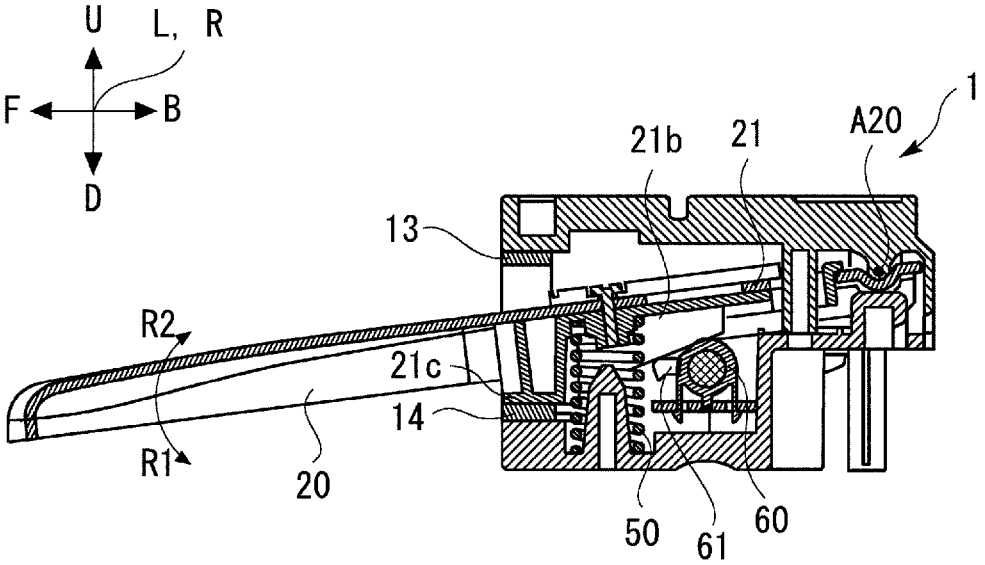
Figure 12A:
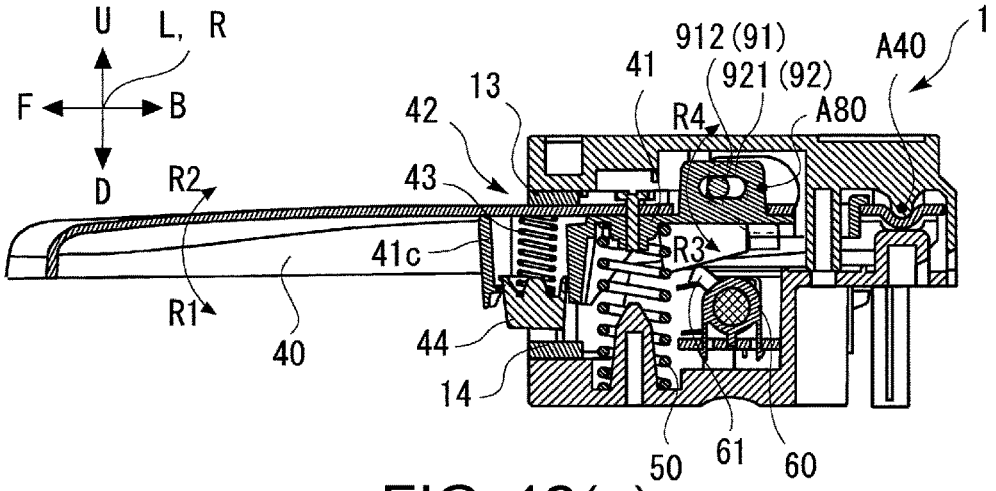
FIGS. 12(*a*) and 12(*b*) are cross-sectional views of the pedal device of electronic keyboard instrument along a IV-IV line in FIG. 1.
Figure 12B:
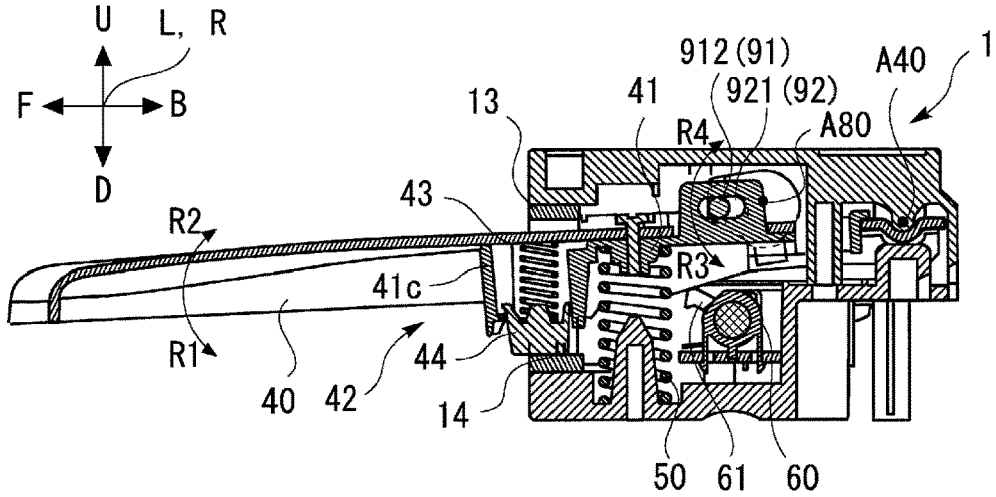
Figure 12C:
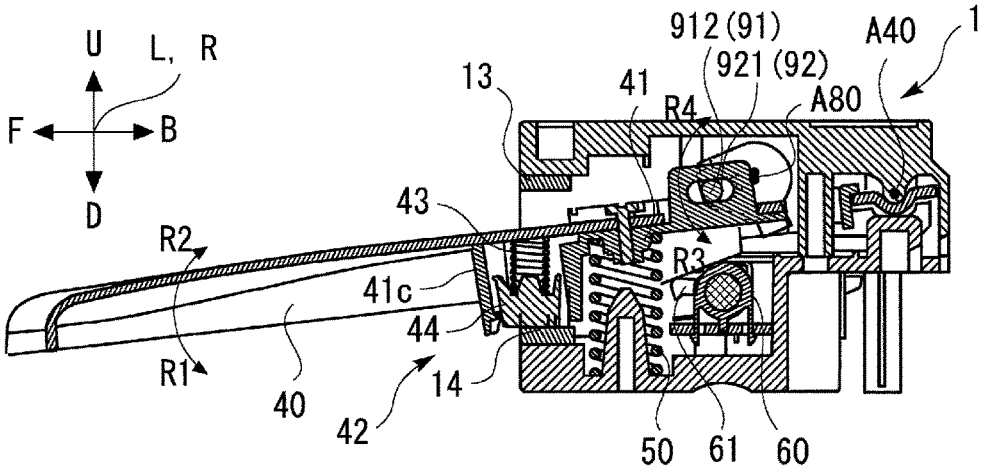

Next, operations when the first pedal 20, the second pedal 30 and the third pedal 40 are stepped are described with reference to FIG. 11 and FIG. 12. FIG. 11 is a cross-sectional view of the pedal device 1 along a III-III line in FIG. 1; FIG. 11(*a*) illustrates the initial state of the first pedal 20, and FIG. 11(*b*) illustrates the maximum stepping state of the first pedal 20. In addition, FIGS. 12(*a*) and 12(*b*) are cross-sectional views of the pedal device 1 along a IV-IV line in FIG. 1; FIG. 12(*a*) illustrates the initial state of the third pedal 40, FIG. 12(*b*) illustrates the specified state of the third pedal 40, and FIG. 12(*c*) illustrates the maximum stepping state of the third pedal 40.

First, the operation when the first pedal 20 is stepped is described with reference to FIGS. 11(*a*) and 11(*b*). Besides, because the operation when the second pedal 30 is stepped is the same as the operation when the first pedal 20 is stepped, description of the operation when the second pedal 30 is stepped is omitted.

If the first pedal 20 is stepped from the initial state shown in FIG. 11(*a*), the first pedal 20 rotates around the rotation axis A20 toward the first direction R1 (the forward stroke). In this case, the lever portion 61 of the sensors 60 is pressed by the transmission portion 21*b* of the actuator 21, and thereby the stepping amount of the first pedal 20 is detected by the sensor 60. As a result, the voltage value corresponding to the stepping amount of the first pedal 20 is output to the electronic keyboard instrument, and a sound effect the same as the soft pedal of the acoustic piano is given to the musical sound of the electronic keyboard instrument. At this time, the first urging force which intends to make the first pedal 20 rotate toward the second direction R2 is applied by the first spring 50 to the first pedal 20 as the reaction force against the stepping operation. In this way, an operation feeling similar to the soft pedal of the acoustic piano can be given to the performer.

Then, if the maximum stepping state shown in FIG. 11(*b*) is reached, the stopper portion 21*c* of the actuator 21 abuts against the cushion 14, and thereby the rotation of the first pedal 20 toward the first direction R1 is regulated.

On the other hand, if the stepping of the first pedal 20 is released from the maximum stepping state shown in FIG. 11(*b*), the first pedal 20 rotates, taking the groove portion 20*a* as the fulcrum, toward the second direction R2 due to the urging force of the first spring 50 (the return stroke). Then, when returning back to the initial state shown in FIG. 11(*a*), the rotation of the first pedal 20 toward the second direction R2 is regulated by abutting against the cushion 13.

Next, the operation when the third pedal 40 is stepped is described with reference to FIGS. 12(*a*) and 12(*b*). If the third pedal 40 is stepped from the initial state shown in FIG. 11(*a*), the third pedal 40 rotates around the rotation axis A40 toward the first direction R1 (the forward stroke). In this case, the lever portion 61 of the sensors 60 is pressed by the transmission portion 41*b* of the actuator 41, and thereby the stepping amount of the third pedal 40 is detected by the sensor 60. As a result, the voltage value corresponding to the stepping amount of the third pedal 40 is output to the electronic keyboard instrument, and a sound effect the same as the damper pedal of the acoustic piano is given to the musical sound of the electronic keyboard instrument. At this time, the first urging force which intends to make the third pedal 40 rotate toward the second direction R2 is applied by the first spring 50 to the third pedal 40 as the reaction force against the stepping operation. In addition, in the forward stroke, the slide shaft portion 912 revolves toward the third direction R3 while sliding on the upper wall 921*a* of the guide hole 921. Accordingly, the first engagement member 91 and the displacement portion 82 on which the first engagement member 91 is installed also rotate toward the third direction R3 in conjunction with the rotation of the third pedal 40.

Then, in the forward stroke, if the specified state shown in FIG. 12(*b*) (a state in which the stepping amount of the third pedal 40 reaches the specified amount) is reached, the movable stopper 44 of the second urging force application mechanism 42 abuts against the cushion 14. In addition, if the third pedal 40 is further stepped from the specified state shown in FIG. 12(*b*), the movable stopper 44 enters the stopper portion 41*c* of the actuator 41 while compressing the second spring 43. At this time, in addition to the first urging force of the first spring 50, the second urging force which intends to make the third pedal 40 rotate toward the second direction R2 is applied by the second spring 43 to the third pedal 40 as the reaction force against the stepping operation.

Moreover, if the maximum stepping state shown in FIG. 12(*c*) is reached, the stopper portion 41*c* of the actuator 41 abuts against the cushion 14, and thereby the rotation of the third pedal 40 toward the first direction R1 is regulated.

On the other hand, if the stepping operation of the third pedal 40 is released from the maximum stepping state shown in FIG. 12(*c*), the third pedal 40 rotates, taking the groove portion 40*a* as the fulcrum, toward the second direction R2 due to the urging forces of the first spring 50 and the second spring 43 (the return stroke). Then, if the stepping amount of the third pedal 40 is smaller than the specified amount, the movable stopper 44 of the second urging force application mechanism 42 leaves from the cushion 14, and the application of the second urging force is released, wherein the second urging force is generated by the elastic force of the second spring 43 and intends to make the third pedal 40 rotate toward the second direction R2. Then, if the initial state shown in FIG. 12(*a*) is reached, the upward rotation of the third pedal 40 is regulated by abutting against the cushion 13.

Herein, in the return stroke, along with the rotation of the third pedal 40 toward the second direction R2, the slide shaft portion 912 revolves toward the fourth direction R4 while sliding on the lower wall 921*b* of the guide hole 921. In this way, the first engagement member 91 and the displacement portion 82 on which the first engagement member 91 is installed also rotate toward the fourth direction R4 in conjunction with the rotation of the third pedal 40. At this time, as described above, the resistance force against the rotation toward the fourth direction R4 is applied to the displacement portion 82 in the damper 80. In this way, the resistance force is applied to the third pedal 40 as the resistance force against the rotation of the third pedal 40 toward the second direction R2 via the engagement unit 90 which connects the displacement portion 82 with the third pedal 40. Therefore, in the return stroke, between the maximum stepping state and the specified state, the first urging force and the second urging force which intend to make the third pedal 40 rotate toward the second direction R2 and the resistance force against the rotation of the third pedal 40 toward the second direction R2 are applied to the third pedal 40. In addition, between the specified state and the initial state in the return stroke, the first urging force which intends to make the third pedal 40 rotate toward the second direction R2 and the resistance force against the rotation of the third pedal 40 toward the second direction R2 are applied to the third pedal 40.

Figure 13:
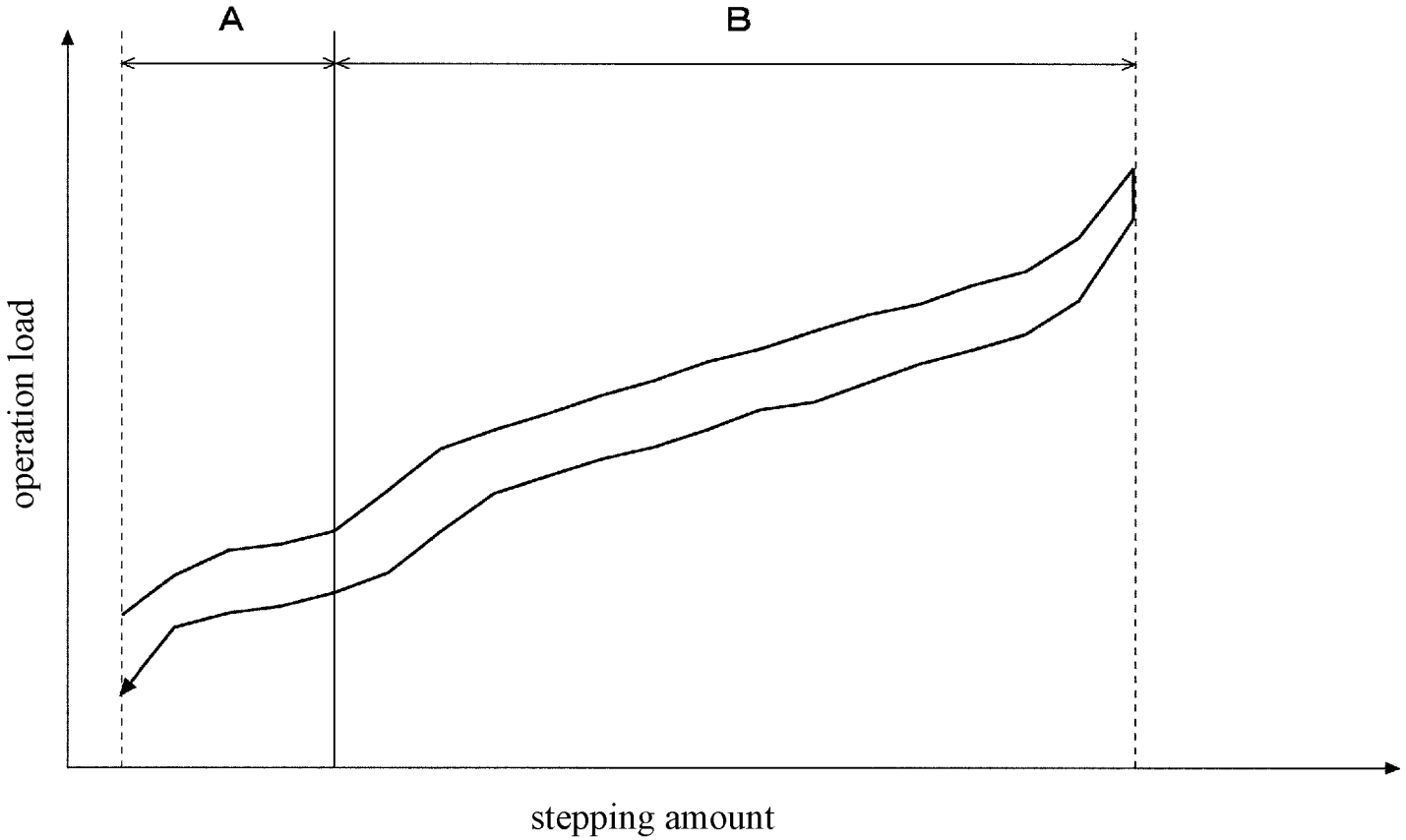
FIG. 13 is a graph showing a relationship between a stepping amount and an operation load of the third pedal.

Next, a relationship between the stepping amount and the operation load of the third pedal 40 is described with reference to FIG. 13. FIG. 13 is a graph showing the relationship between the stepping amount and the operation load of the third pedal 40. Besides, in FIG. 13, a range between the initial state and the specified state is indicated by a segment A. In addition, a range between the specified state and the maximum stepping state is indicated by a segment B.

First, the forward stroke is described. In the forward stroke, between the initial state and the specified state, only the first urging force which intends to make the third pedal 40 rotate toward the second direction R2 is applied by the elastic force of the first spring 50, and thus the operation load of the third pedal 40 linearly increases along with an increase in the stepping amount. In addition, between the specified state and the maximum stepping state in the forward stroke, in addition to the first urging force, the second urging force which intends to make the third pedal 40 rotate toward the second direction R2 is applied by the elastic force of the second spring 43. Therefore, the operation load of the third pedal 40 linearly increases along with an increase in the stepping amount at a rate of change greater than that from the initial state to the specified state. Accordingly, in the forward stroke, the operation load of the third pedal 40 can be changed stepwise corresponding to the stepping amount.

Next, the return stroke is described. In the return stroke, between the maximum stepping state and the specified state, the first urging force and the second urging force which intend to make the third pedal 40 rotate toward the second direction R2 and the resistance force against the rotation of the third pedal 40 toward the second direction R2 are applied to the third pedal 40. Therefore, the operation load from the maximum stepping state to the specified state in the return stroke is smaller than the operation load from the specified state to the maximum stepping state in the forward stroke.

In addition, between the specified state and the initial state in the return stroke, the first urging force which intends to make the third pedal 40 rotate toward the second direction R2 and the resistance force against the rotation of the third pedal 40 toward the second direction R2 are applied to the third pedal 40. Therefore, the operation load from the specified state to the initial state in the return stroke is smaller than the operation load from the initial state to the specified state in the forward stroke. Besides, the operation load of the third pedal 40 linearly decreases between the maximum stepping state and the specified state along with a decrease in the stepping amount at a rate of change greater than that from the specified state to the initial state. Accordingly, in the return stroke, the operation load of the third pedal 40 can also be changed stepwise corresponding to the stepping amount.

Accordingly, in the stepping operation of the pedal device 1, the damper 80 applies the resistance force against the rotation of the third pedal 40 toward the fourth direction R4 to the third pedal in the return stroke. That is, the pedal load in the return stroke is reduced by the damper 80. Therefore, the operation load of the third pedal 40 in the return stroke is smaller than the operation load in the forward stroke. In this way, in the stepping operation of the third pedal 40, the operation feeling similar to the damper pedal of the acoustic piano can be obtained. Furthermore, because the operation load of the third pedal 40 is changed stepwise corresponding to the stepping amount, an operation feeling more similar to the damper pedal of the acoustic piano can be achieved.

<Operation and Effect>

As described above, the pedal device 1 according to the embodiment includes the damper 80 which applies the resistance force against the rotation of the third pedal 40 to the third pedal 40 during the rotation of the third pedal 40 toward the second direction R2. Accordingly, the operation load when the third pedal 40 rotates toward the second direction R2 (the return stroke) can be smaller than the operation load when the third pedal 40 rotates toward the first direction R1 (the forward stroke).

When the damper pedal of the acoustic piano is stepped, the hysteresis is generated in the operation load, and there is a tendency that the operation load is smaller in the return stroke of the stepping operation than in the forward stroke. According to the pedal device 1 of the embodiment, the operation load in the return stroke can be smaller than the operation load in the forward stroke. Therefore, in the stepping operation of the third pedal 40, the hysteresis characteristic the same as the damper pedal of the acoustic piano can be applied to the operation load. As a result, the operation feeling similar to the damper pedal of the acoustic piano can be achieved.

Herein, if a configuration in which a predetermined member is pressed against the third pedal 40 is employed, and a configuration in which the resistance force is applied to the third pedal 40 by a friction force generated between the third pedal 40 and the member during the rotation of the third pedal 40 is employed, a problem below is generated. That is, because the third pedal 40 and the member are worn due to the friction force in the part where the third pedal 40 and the member are in contact with each other, a desired load characteristic cannot be obtained for a long period. On the other hand, the pedal device 1 according to the embodiment is configured to apply the resistance force to the third pedal 40 by the damper 80 with high durability. Therefore, the generation of the above-described problem can be suppressed, and the desired load characteristic can be obtained for a long period. That is, the operation feeling similar to the damper pedal of the acoustic piano can be maintained for a long period.

Besides, in the embodiment, the damper 80 is configured to apply the resistance force against the rotation of the third pedal 40 to the third pedal 40 during the rotation of the third pedal 40 toward the second direction R2, however, the configuration of the damper 80 is not limited hereto. That is, the damper 80 may also be configured to apply the resistance force against the rotation of the third pedal 40 to the third pedal 40 during the rotation of the third pedal 40 toward the first direction R1. That is, the damper 80 may also be configured in a manner that the body portion 81 applies the resistance to the displacement portion 82 when the displacement portion 82 rotates toward the third direction R3. When being configured in this way, the damper 80 applies the resistance force against the rotation of the third pedal 40 toward the first direction R1 to the third pedal in the forward stroke. That is, because the pedal load in the forward stroke is increased by the damper 80, the operation load of the third pedal 40 in the return stroke can be smaller than the operation load in the forward stroke. In addition, the damper 80 may also be, for example, a so-called two-way damper, and apply the resistance forces against the rotation of the third pedal 40 to the third pedal 40 during both the rotation toward the first direction R1 and the rotation toward the second direction R2 of the third pedal 40. In this case, in the forward stroke the pedal load is increased, and in the return stroke the pedal load is reduced, and thus the operation load of the third pedal 40 in the return stroke can be smaller than the operation load in the forward stroke. That is, the damper 80 may apply the resistance force against the rotation of the third pedal 40 to the third pedal 40 during the rotation of the third pedal 40 toward at least one of the first direction R1 and the second direction R2. In this way, in the stepping operation of the third pedal 40, the hysteresis characteristic the same as the damper pedal of the acoustic piano can be applied to the operation load, and the operation feeling similar to the damper pedal of the acoustic piano can be achieved.

However, the pedal device 1 according to the embodiment is configured in a manner that the damper applies the resistance force against the rotation of the pedal to the third pedal 40 during the rotation of the third pedal 40 toward the second direction R2. Accordingly, in the forward stroke, the damper 80 does not contribute to the operation load, and in the return stroke the operation load is reduced by the damper 80. Therefore, an existing coil spring designed to obtain the predetermined load characteristic in the forward stroke can be diverted as the first spring 50 or the second spring 43.

In addition, the damper 80 has the body portion 81 fixed to the chassis 10, and the displacement portion 82 capable of the rotation acting as the predetermined relative displacement with respect to the body portion 81. In addition, the pedal device 1 includes the engagement unit 90 which engages the third pedal 40 with the displacement portion 82 and makes the displacement portion 82 relatively rotate with respect to the body portion 81 in conjunction with the rotation of the third pedal 40. Moreover, the damper 80 is configured to apply the resistance force against the rotation of the displacement portion 82 from the body portion 81 to the displacement portion 82 during the rotation of the displacement portion 82 with respect to the body portion 81. In this way, the resistance forces against the rotation of the third pedal 40 can be applied to the third pedal 40 in conjunction with the rotation of the third pedal 40.

Besides, translational motion may also be employed as the predetermined relative displacement instead of rotation. For example, the damper 80 may not be a rotary damper but be configured like a cylinder damper to apply a resistance force against the translational motion of the displacement portion 82 from the body portion 81 to the displacement portion 82 by the translational motion of the displacement portion 82 with respect to the body portion 81.

Herein, the pedal device 1 according to the embodiment employs, as the damper 80, the rotary damper in which the displacement portion 82 rotates relatively with respect to the body portion 81 and thereby the body portion 81 applies the resistance force to the displacement portion 82. Moreover, the damper 80 is arranged in a manner that the rotation axis A80 of the displacement portion 82 is parallel to the rotation axis A40 of the third pedal 40. Accordingly, because of the configuration in which the rotary damper is laid down, the pedal device 1 can be suppressed from being bulky vertically.

In addition, the engagement unit 90 has the slide shaft portion 912 which is arranged on the displacement portion 82 and arranged eccentrically with the rotation axis A80 of the displacement portion 82, and the guide hole 921 which is arranged in the third pedal 40 and accepts the slide shaft portion 912. Moreover, the engagement unit 90 is configured in a manner that the slide shaft portion 912 revolves around the rotation axis A80 and slides along the inner wall of the guide hole 921 in conjunction with the rotation of the third pedal 40, and thereby the displacement portion 82 rotates with respect to the body portion 81. Accordingly, the resistance force against the rotation of the third pedal 40 can be applied to the third pedal 40 in conjunction with the rotation of the third pedal 40 with a simple structure. Besides, positions in which the slide shaft portion 912 and the guide hole 921 are arranged may be reversed. That is, the slide shaft portion 912 may be arranged on the third pedal 40 side, and the guide hole 921 may be arranged on the first engagement member 91 (the displacement portion 82) side. In addition, the displacement portion 82 and the first engagement member 91 may be formed integrally, and the second engagement member 92 and the third pedal 40 may be formed integrally.

Furthermore, in the pedal device 1 according to the embodiment, the first spring 50 is arranged closer to the operation position stepped by the performer than the rotation axis A40 of the third pedal 40, and the engagement unit 90 is arranged between the rotation axis A40 and the first spring 50. That is, the engagement unit 90 is arranged closer to the rotation axis A40 than the first spring 50. Herein, when a rotation range of the third pedal 40 is the same, the farther away an arrangement position of the guide hole 921 is from the rotation axis A40, the longer an up and down stroke of the guide hole 921 during the rotation of the third pedal 40 is. Moreover, if the rotation range of the third pedal 40 is the same and the stroke of the guide hole 921 becomes long, it is necessary to increase an eccentricity with respect to the rotation axis A80 of the slide shaft portion 912 accepted by the guide hole 921, and there is a risk of increased size of the engagement unit 90. Therefore, the arrangement position of the engagement unit 90 may be closer to the rotation axis A40. On the other hand, with regard to the first spring 50, based on a leverage principle, the urging force of the first spring 50 required for obtaining the predetermined operation load becomes larger as the first spring 50 gets closer to the rotation axis A40. Therefore, if the arrangement position of the first spring 50 is close to the rotation axis A40, the elastic force is required for obtaining the predetermined operation load, and there is a risk of increased size of the first spring 50. Therefore, the arrangement position of the first spring 50 may be farther away from the rotation axis A40. By arranging the engagement unit 90 closer to the rotation axis A40 than the first spring 50, the pedal device 1 according to the embodiment can suppress the size increasing of the engagement unit 90 and the first spring 50 caused by the positional relationship between the engagement unit 90 and the first spring 50.

Besides, the hysteresis application structure 100 according to the embodiment can also be applied to the first pedal 20 and the second pedal 30 corresponding to the soft pedal and the sostenuto pedal in the acoustic piano. That is, the dampers 80 may be configured to apply the resistance forces against the rotation of the first pedal 20 and the second pedal 30 during the rotation of the first pedal 20 and the second pedal 30 toward the second direction R2. In the stepping operations of the soft pedals and the sostenuto pedals of the acoustic piano, similar to the damper pedal, there is also a tendency that a hysteresis in which the operation load is smaller in the return stroke than in the forward stroke. Therefore, the operation feelings similar to the soft pedal and the sostenuto pedal of the acoustic piano can be achieved by applying the hysteresis application structure 100 to the first pedal 20 and the second pedal 30.

In addition, the pedal device 1 according to the embodiment further includes the second urging force application mechanism 42 compressed when the stepping amount of the third pedal 40 exceeds the specified amount and urging the third pedal 40 in the second direction R2 by the elastic force. Accordingly, the operation load of the third pedal 40 can be changed stepwise corresponding to the stepping amount. Herein, the damper pedal of the acoustic piano has a characteristic that a pedal load increases rapidly at the beginning of contacting the damper in the stepping operation. According to the pedal device 1, the operation feeling more similar to the damper pedal of the acoustic piano can be achieved.

The materials and shapes mentioned in the above embodiment are merely examples, and obviously other materials and shapes can be employed. For example, in the above embodiment, the case is described in which the first pedal 20, the second pedal 30 and the third pedal 40 are formed into a long plate shape by a metal material such as brass, iron or the like, but the disclosure is not limited hereto. For example, the first pedal 20, the second pedal 30 and the third pedal 40 may be formed into a long plate shape by another metal material such as stainless steel or the like, or be formed into a long plate shape by a resin material such as ABS resin, POM resin or the like.

In the above embodiment, the case in which the pedal device 1 includes three pedals the first pedal 20, the second pedal 30 and the third pedal 40 is described, but the disclosure is not limited hereto. For example, the pedal device 1 may include the third pedal 40 only, or may include two pedals, that is, the first pedal 20 or the second pedal 30, and the third pedal 40. Alternatively, the pedal device 1 may include four or more pedals containing the third pedal 40.

In the above embodiment, the first pedal 20 and the second pedal 30 respectively correspond to the soft pedal and the sostenuto pedal of the acoustic piano, but the disclosure is not limited hereto. The first pedal 20 and the second pedal 30 may also be configured to give other sound effects to the musical sound of the electronic keyboard instrument other than corresponding to the soft pedal and the sostenuto pedal.

In the above embodiment, the case in which the first spring 50 and the second spring 43 are made of coil-shaped compression springs is described, but the disclosure is not limited hereto. The first spring 50 and the second spring 43 may also be made of other elastic bodies which can apply the urging forces to the third pedal 40 by elastic forces. Other elastic bodies may be, for example, a rubber-like elastic body, an elastic body made of a resin material, or the like.

It can be easily inferred that various modifications and improvements can be made to the configurations described in the above embodiments in a scope not departing from the aim.

What is claimed is:

1. A pedal device, being a pedal device of electronic keyboard instrument and comprising:

a chassis;

a pedal rotatably supported by the chassis and rotated in a first direction by stepping operations;

a first urging unit configured to apply, to the pedal, an urging force to rotate the pedal toward a second direction opposite to the first direction corresponding to a stepping amount of the pedal; and a damper which is configured to apply a resistance force against a rotation of the pedal to the pedal during the rotation of the pedal toward at least one of the first direction or the second direction, the damper comprises a body portion fixed to the chassis, and a displacement portion protruding at one end surface in an axial direction of the body portion, the body portion of the damper is configured to apply a resistance force against a relative displacement of the displacement portion to the displacement portion during the relative displacement of the displacement portion with respect to the body portion.

2. The pedal device according to claim 1, wherein the damper is configured to apply the resistance force against the rotation of the pedal to the pedal during the rotation of the pedal toward the second direction.

3. The pedal device according to claim 1, wherein the pedal device further comprises an engagement unit which is configured to engage with the pedal and the displacement portion and to move in conjunction with the rotation of the pedal to generate the relative displacement of the displacement portion with respect to the body portion.

4. The pedal device according to claim 3, wherein the damper is a rotary damper in which the displacement portion relatively rotates with respect to the body portion, and the body portion is configured to apply the resistance force to the displacement portion by rotating of the displacement portion with respect to the body portion; and a rotation axis of the displacement portion is arranged to be parallel to a rotation axis of the pedal.

5. The pedal device according to claim 4, wherein the engagement unit comprises:

a slide shaft portion which is arranged on one of the displacement portion and the pedal and arranged eccentrically with the rotation axis of the displacement portion, and a guide hole which is arranged on the other of the displacement portion and the pedal and accepts the slide shaft portion, and wherein the slide shaft portion is configured to revolve around the rotation axis of the displacement portion in conjunction with the rotation of the pedal and to slide along an inner wall of the guide hole and thereby thus to cause the displacement portion rotate with respect to the body portion.

6. The pedal device according to claim 5, wherein the first urging unit is arranged closer to an operation position to be stepped on by a performer than the rotation axis of the pedal, and the engagement unit is arranged between the rotation axis of the pedal and the first urging unit.

7. The pedal device according to claim 1, further comprising a second urging unit which is configured to be compressed when the stepping amount of the pedal exceeds a specified amount and to urge the pedal in the second direction by an elastic force.

8. A pedal device of electronic keyboard instrument, comprising:

a chassis;

a pedal rotatably supported by the chassis;

a first urging unit configured to apply an urging force to the pedal corresponding to a stepping amount of the pedal; and a damper which is configured to apply a resistance force against rotation of the pedal to the pedal during the rotation toward at least one of a first direction in which the pedal is stepped to rotate and a second direction opposite to the first direction the damper comprises a body portion fixed to the chassis, and a displacement portion protruding at one end surface in an axial direction of the body portion, the body portion of the damper is configured to apply a resistance force against a relative displacement of the displacement portion to the displacement portion during the relative displacement of the displacement portion with respect to the body portion.

9. The pedal device according to claim 8, wherein the first urging unit is configured to rotate the pedal toward the second direction.

10. The pedal device according to claim 8, wherein the damper configured to apply the resistance force against the rotation of the pedal in the rotation of the pedal toward the second direction.

11. The pedal device according to claim 8, wherein the pedal device further comprises an engagement unit which is configured to be engage with the pedal and the displacement portion and to move in conjunction with the rotation of the pedal to cause a relative displacement of the displacement portion with respect to the body portion.

12. The pedal device according to claim 11, wherein the displacement portion relatively rotates with respect to the body portion, and the body portion of the damper applies the resistance force to the displacement portion by rotating of the displacement portion with respect to the body portion.

13. The pedal device according to claim 11, wherein a rotation axis of the displacement portion is parallel to a rotation axis of the pedal.

14. The pedal device according to claim 13, wherein the engagement unit comprises a slide shaft portion which is arranged on one of the displacement portion and the pedal and arranged eccentrically with the rotation axis of the displacement portion, and a guide hole which is arranged on the other of the displacement portion and the pedal and accepts the slide shaft portion.

15. The pedal device according to claim 14, wherein the slide shaft portion is configured to revolve around the rotation axis of the displacement portion in conjunction with the rotation of the pedal and to slide along an inner wall of the guide hole and thus to cause the displacement portion rotate with respect to the body portion.

16. The pedal device according to claim 13, wherein the first urging unit is arranged closer to an operation position to be stepped on by a performer than the rotation axis of the pedal.

17. The pedal device according to claim 13, wherein the engagement unit is arranged between the rotation axis of the pedal and the first urging unit.

18. The pedal device according to claim 8, wherein the damper s a rotary damper.

19. The pedal device according to claim 8, further comprising a second urging unit which is compressed when the stepping amount of the pedal exceeds a specified amount and urges the pedal in the second direction by an elastic force.

* * * * *